US011458596B1

(12) United States Patent
Kirk

(10) Patent No.: US 11,458,596 B1
(45) Date of Patent: Oct. 4, 2022

(54) MECHANICAL SEIZING AND LOCKING CLAMP DEVICE

(71) Applicant: David J. Kirk, Bellingham, WA (US)

(72) Inventor: David J. Kirk, Bellingham, WA (US)

( * ) Notice: Subject to any disclaimer, the term of this patent is extended or adjusted under 35 U.S.C. 154(b) by 516 days.

(21) Appl. No.: 16/379,058

(22) Filed: Apr. 9, 2019

Related U.S. Application Data

(60) Provisional application No. 62/654,732, filed on Apr. 9, 2018.

(51) Int. Cl.
*B25B 5/16* (2006.01)
*B25B 7/14* (2006.01)
*B25B 5/04* (2006.01)

(52) U.S. Cl.
CPC ..... *B25B 5/163* (2013.01); *B25B 5/04* (2013.01); *B25B 7/14* (2013.01)

(58) Field of Classification Search
CPC ..... B25B 5/04; B25B 5/163; B25B 7/14
USPC ..... 269/249, 257, 96; 294/116
See application file for complete search history.

(56) References Cited

U.S. PATENT DOCUMENTS 3,041,712 A * 7/1962 Wurzel ..... B25B 27/205 29/229
3,132,550 A * 5/1964 Sion ..... B25B 7/08 81/423
4,104,752 A * 8/1978 Amrein ..... B25B 7/02 7/107
4,206,663 A * 6/1980 Pace ..... B25B 7/02 7/125
4,815,210 A * 3/1989 Burrage ..... A61B 17/282 30/176
5,862,552 A * 1/1999 Koelewyn ..... B25B 7/08 7/132
9,027,913 B2 * 5/2015 Li ..... B25B 25/00 269/6
2003/0079576 A1 * 5/2003 Lo ..... B25B 5/06 81/318
2015/0101128 A1 * 4/2015 Warner ..... F41B 5/148 7/125
2016/0184980 A1 * 6/2016 Takasaki ..... B25B 7/02 7/133

* cited by examiner

*Primary Examiner* — Seahee Hong
(74) *Attorney, Agent, or Firm* — Michael J. Tavella

(57) ABSTRACT

A clamping and locking device that uses two main parts. The two parts are connected by an axle, which acts as a fulcrum. The assembled clamp has jaws that meet together on one end of the assembled parts. There is a multi-radius latching system on the inside of the handle arms located on the other side of the axle. The handle arms may be straight or curved. The ends of the handle arms can be straight, or have hooks, ring-holes, hand-grips, or an assortment of other useful end-of-handle designs.

9 Claims, 28 Drawing Sheets

OUTSIDE VIEW

INSIDE VIEW

FRONT VIEW

10

REAR VIEW

10

OUTSIDE VIEW

INSIDE VIEW

TOP VIEW

BOTTOM VIEW

FRONT VIEW

11

REAR VIEW

11

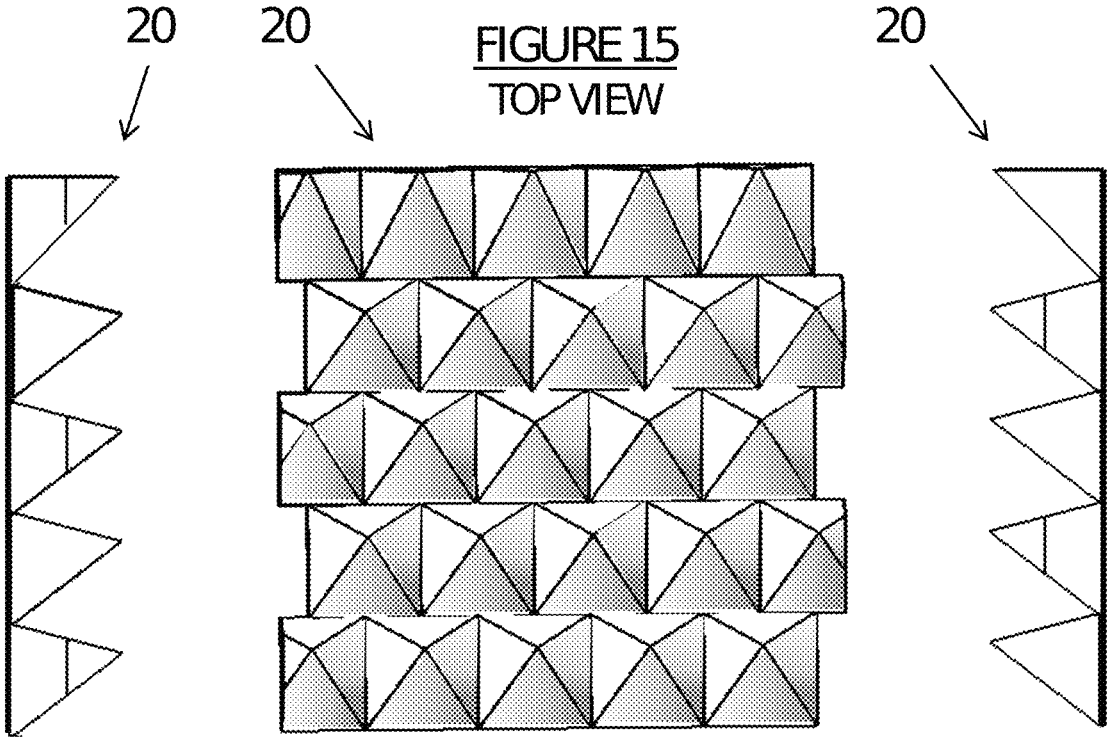
FIGURE 15
TOP VIEW
FIGURE 18
LEFT VIEW
FIGURE 19
RIGHT VIEW
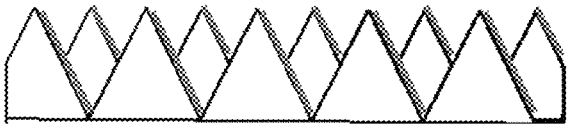
FIGURE 16
FRONT VIEW
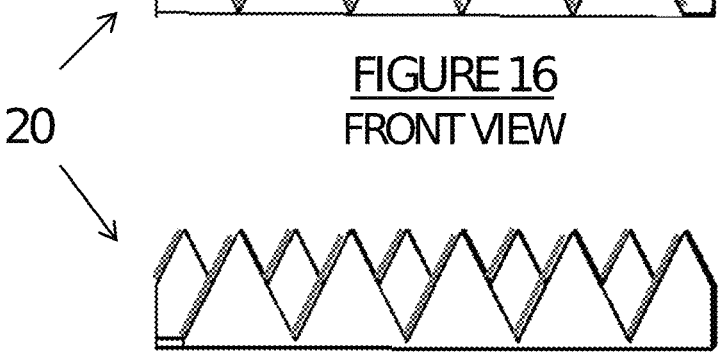
FIGURE 17
REAR VIEW

TOP VIEW

FRONT VIEW

FRONT VIEW

FRONT VIEW

Top View

Top View

Side View

Side View

Side View

Perspective View

Perspective View

FIG. 31 FIG. 32 FIG. 33 FIG. 34
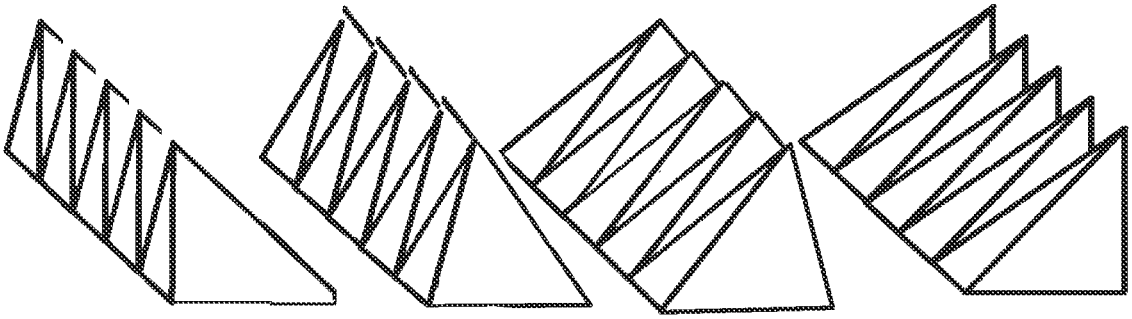
DIRECTION OF FORCE OF MATERIAL
PULLING AGAINST TEETH.
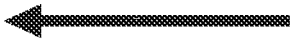

Perspective View

Rear View

MECHANICAL SEIZING AND LOCKING CLAMP DEVICE

CROSS REFERENCE TO RELATED APPLICATIONS

This application claims benefit of Provisional application 62/654,732 filed Apr. 9, 2018

STATEMENT REGARDING FEDERALLY SPONSORED RESEARCH AND DEVELOPMENT

Not Applicable

BACKGROUND OF THE INVENTION

1. Field of the Invention

This invention relates to clamps and particularly to clamps with interlocking teeth.

2. Description of the Prior Art

Small clips and clamps do not hold a heavy weight well over time, if at all. The effectiveness of the mouth for arresting a material, the length of the arms, and the method for holding the arms together are the problems. Some clips and clamps have a collar that slides up and squeezes the two arms together. Some rely on turning a knob in a screwing motion, or closing a lever, that tightens the arms together; some have a sliding mouth jaw that binds both jaws together over the material. All these designs have relatively long bodies, which allow for enough flex in the part design, the part material, or both, so that the clip or clamp fails.

Another problem are designs that have an "easy-on easy-off" system for rope or line that can be tied to the end of the clip or clamp. Other clamps usually have a hole that the line has to go through and then come back to itself and tie a complex knot. Some clips or clamps have a hook instead of a hole, and the knotted line can slide off the end of the hook.

BRIEF DESCRIPTION OF THE INVENTION

The instant invention overcomes the difficulties described above. This invention is a clamp that has relatively short arms that have an axle as a fulcrum. The short arms increase the clamping power in the jaw of the mouth. The diameter of the axle d (see FIG. 10) is greater than the width w of the arm (see FIG. 11) that rides on the axle, thereby giving said arm excellent lateral stability, and minimizing flexing. The teeth in the mouth of the clamp are unique in that they distort the material the maximum amount it can in the least number of square inches of mouth size. The teeth arrest the material from both forward movement as well as lateral movement. The arms are held together by a practically zero slippage multi-radius latching system that is held together by several small latches catching on the inside of each arm. The latches disconnect from each other by prying the two arms away from each other, and the opposing latches then come away from each other over a very small latch height, and the arms simply fall open. The two-hook end of this invention is designed so that a knot can be tied in the end of a line, then the knot is placed into the cradle of the hook, where the rope is held tight by its girth being larger than the hook hole diameter. The line can than simply be tied in a half-hitch knot over the hook on the other arm, thereby holding the two arms together, as well as holding them even tighter together as more pull is applied to the line. The line is released by undoing simple half-hitch knot.

BRIEF DESCRIPTION OF THE DRAWINGS

FIG. 15 is a top view of the teeth on one part of the clamp.

FIG. 16 is a front view of the teeth on one part of the clamp.

FIG. 17 is a rear view of the teeth on one part of the clamp.

FIG. 18 is a left side view of the teeth on one part of the clamp.

FIG. 19 is a right side view of the teeth on one part of the clamp.

FIG. 31 is a perspective view of a row of teeth showing a leaning bias.

FIG. 32 is a perspective view of a row of teeth showing a second degree of leaning bias.

FIG. 33 is a perspective view of a row of teeth showing a third degree of leaning bias.

FIG. 34 is a perspective view of a row of teeth showing a second degree of leaning bias.

DETAILED DESCRIPTION OF THE INVENTION

Figure 1:
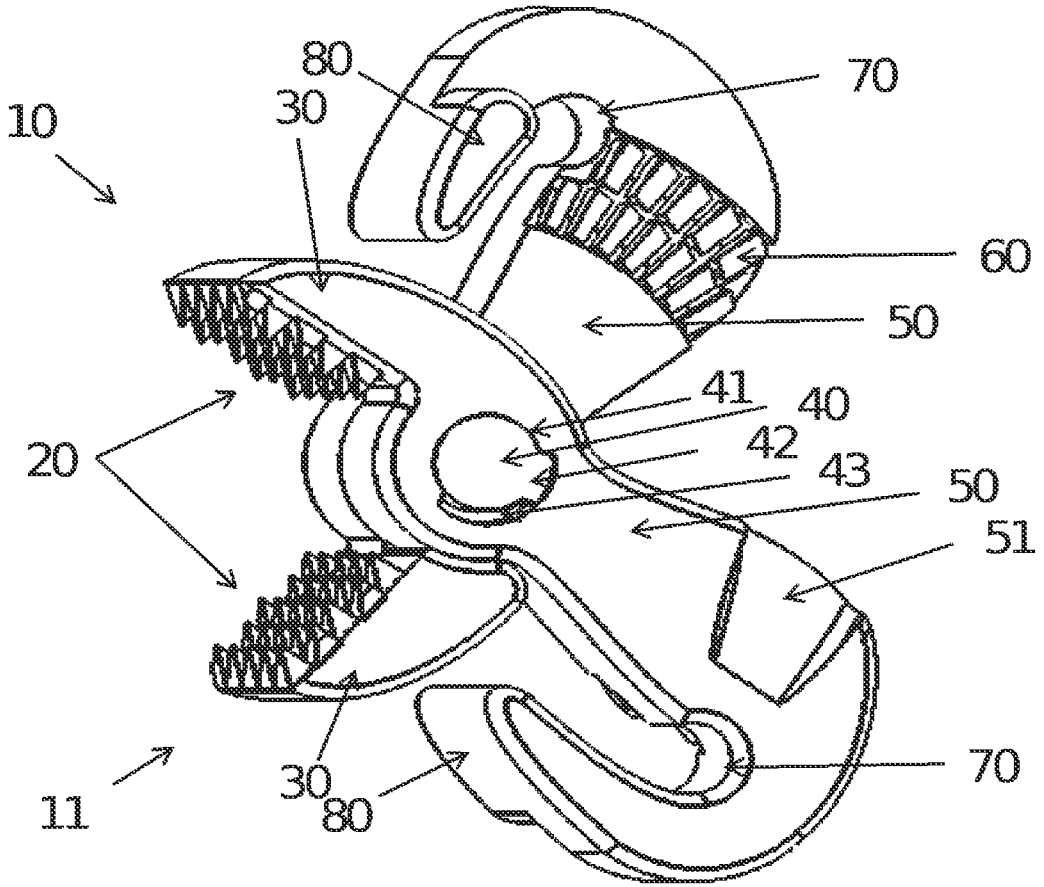
FIG. 1 is a forward perspective view of a first embodiment of the assembled clamp.

In FIG. 1, a first embodiment of this invention is shown. It is comprised of two parts: a clamp body with hole 10 and a clamp body with axle 11. The different parts of this invention are the teeth 20, the jaws 30, the axle 40, the arms 50, the multi-radius latches 60 on the inside of both arms, the hooks 70, and the end-of-hook flange 80. The invention is assembled by inserting the axle 40 into the hole 41, and then twisting until retained in place by the axle tab 42 riding on the tab retaining ledge 43 inside the hole in what can be described as a "bayonet twist-fit connection". The two clamp bodies 10 and 11 "scissor" together, both opening and closing the assembled clamp. The clamp is held in clamped position by the latches 60, located on the inside of each arm, opposing and engaging each other. The latches are in sets of rows, each row on a different radius from the center of the axle. The clamp is disengaged by pulling the two flexible arms 50 away from each other until their latches (60) disengage from each other, allowing the clamp bodies 10 and 11 to move freely again on the axle. A cord, or such, can be held by the hook 70, and the cord may be guided closer to the hook by the trough 51.

Figure 2:
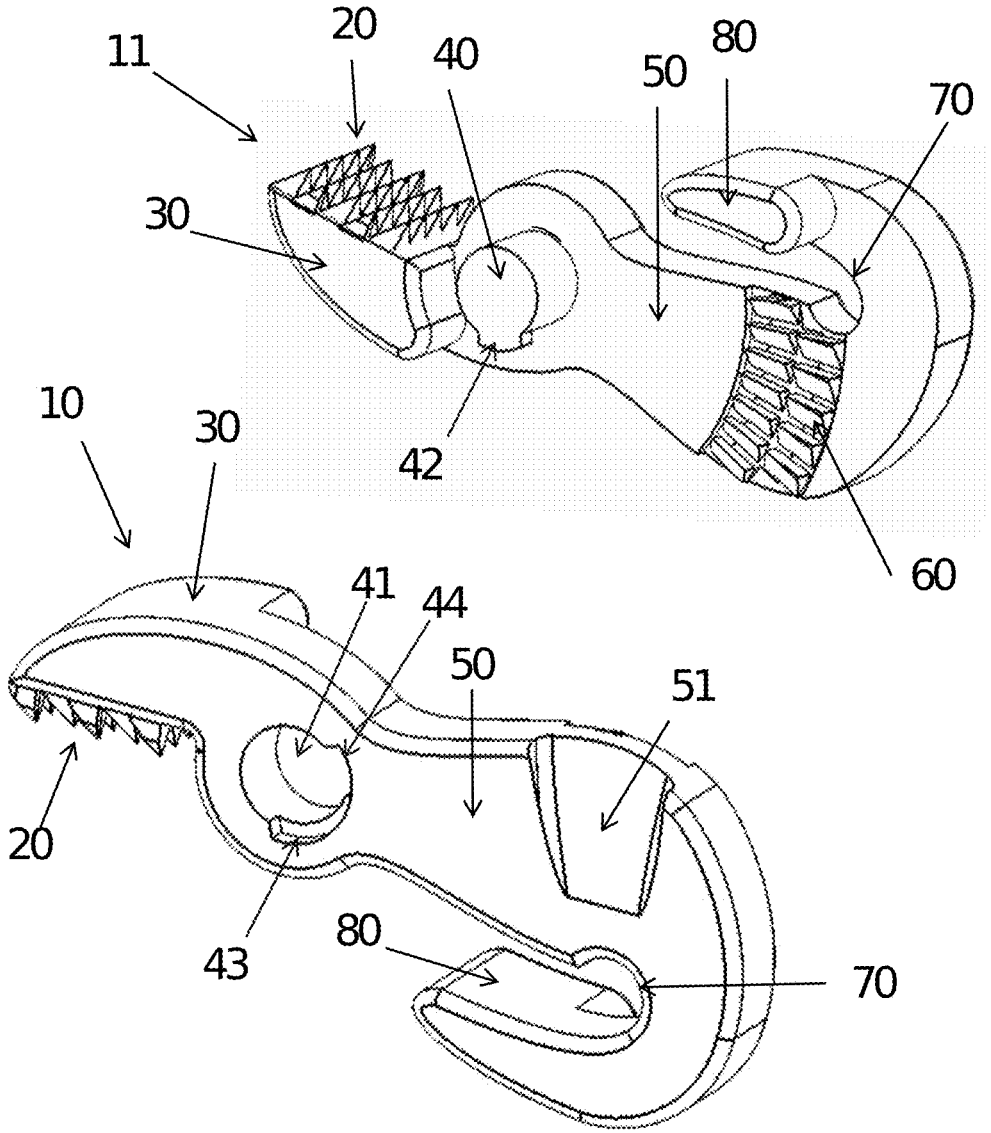
FIG. 2 is an exploded view of a first embodiment of the clamp.
Figure 3:
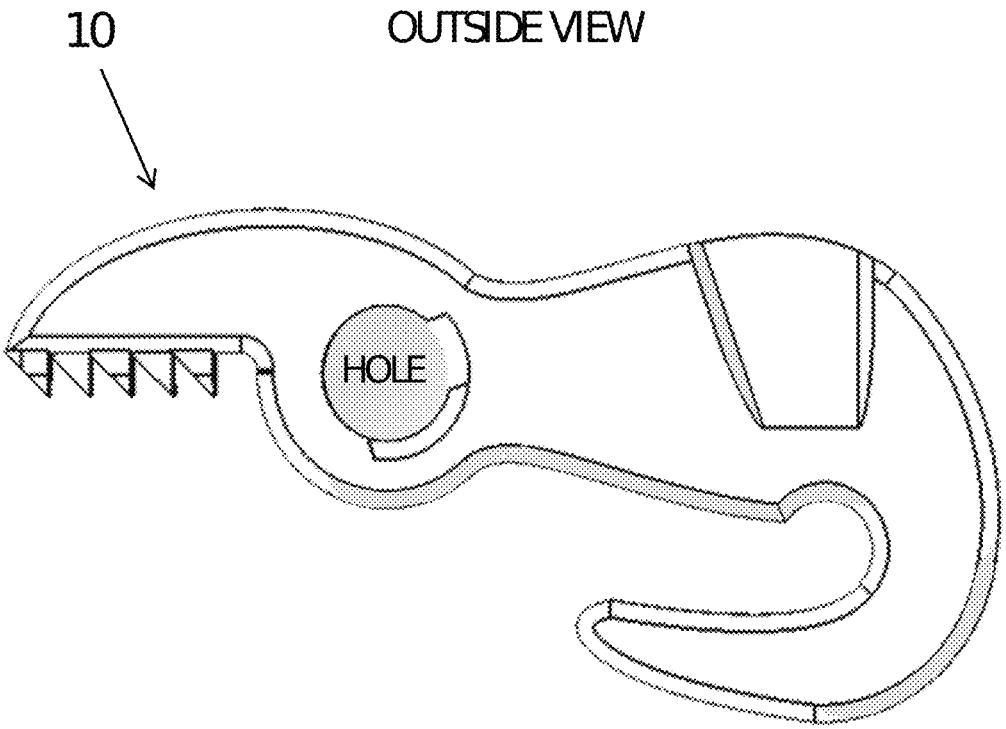
FIG. 3 is an outside view of one side of a first embodiment of the clamp.
Figure 4:
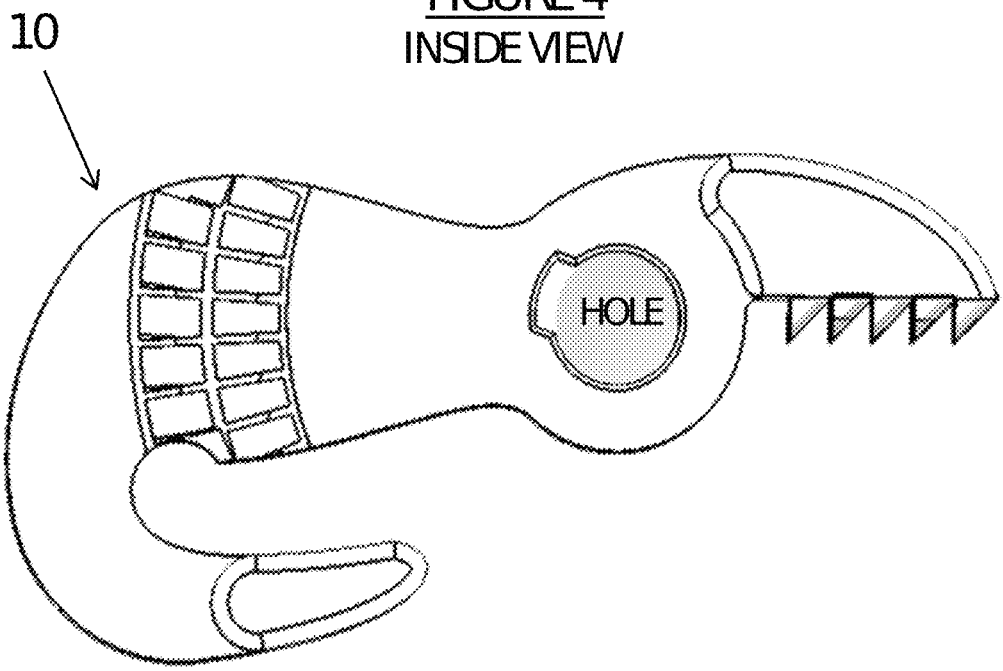
FIG. 4 is an inside view of one side of a first embodiment of the clamp.
Figure 5:
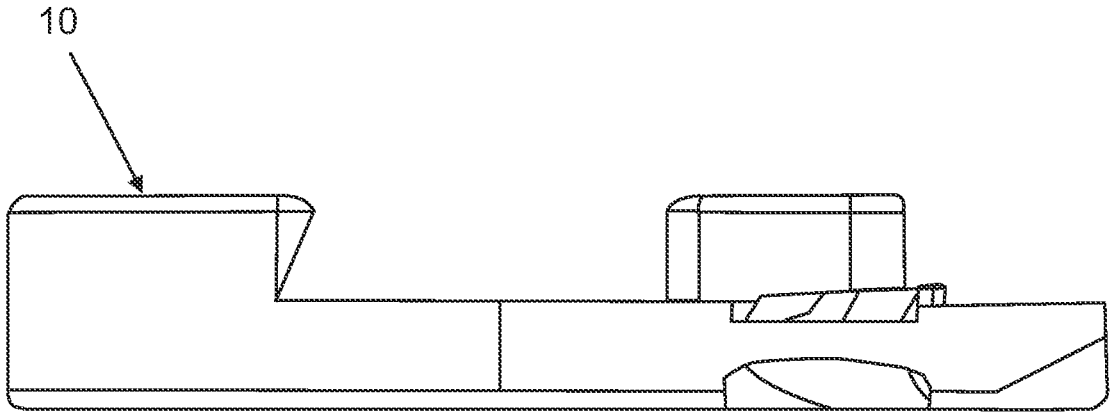
FIG. 5 is a top view of one side of a first embodiment of the clamp.
Figure 6:
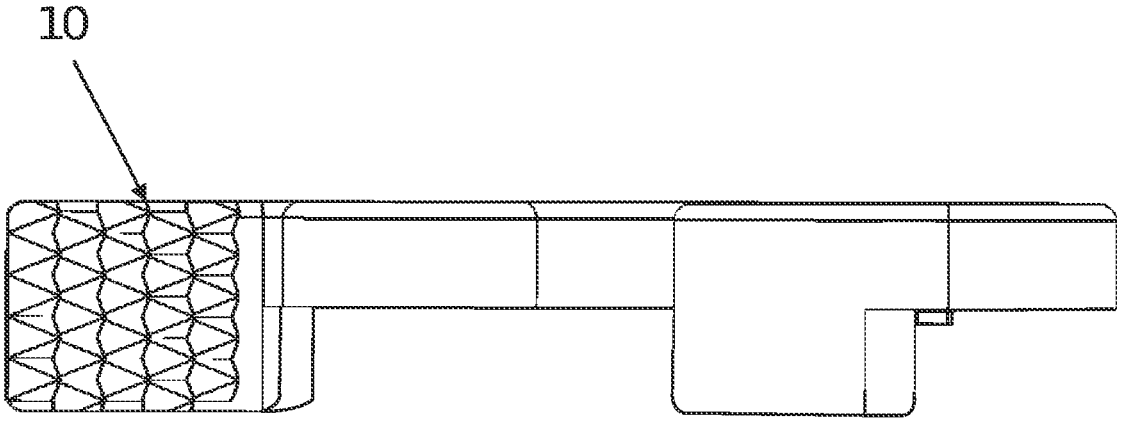
FIG. 6 is a bottom view of one side of a first embodiment of the clamp.
Figure 7:
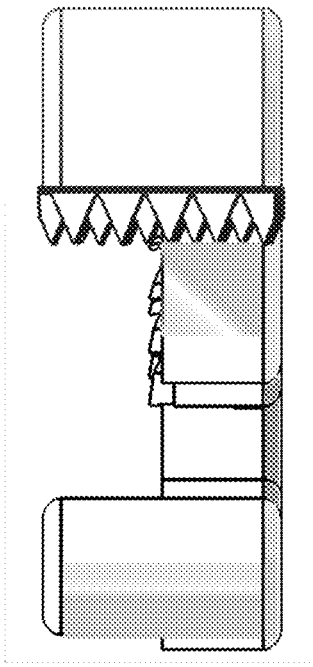
FIG. 7 is a front view of one side of a first embodiment of the clamp.
Figure 8:
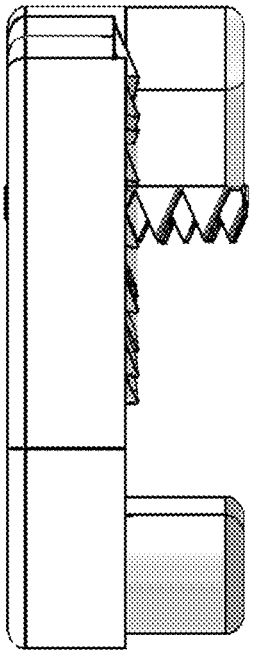
FIG. 8 is a rear view of one side of a first embodiment of the clamp.
Figure 9:
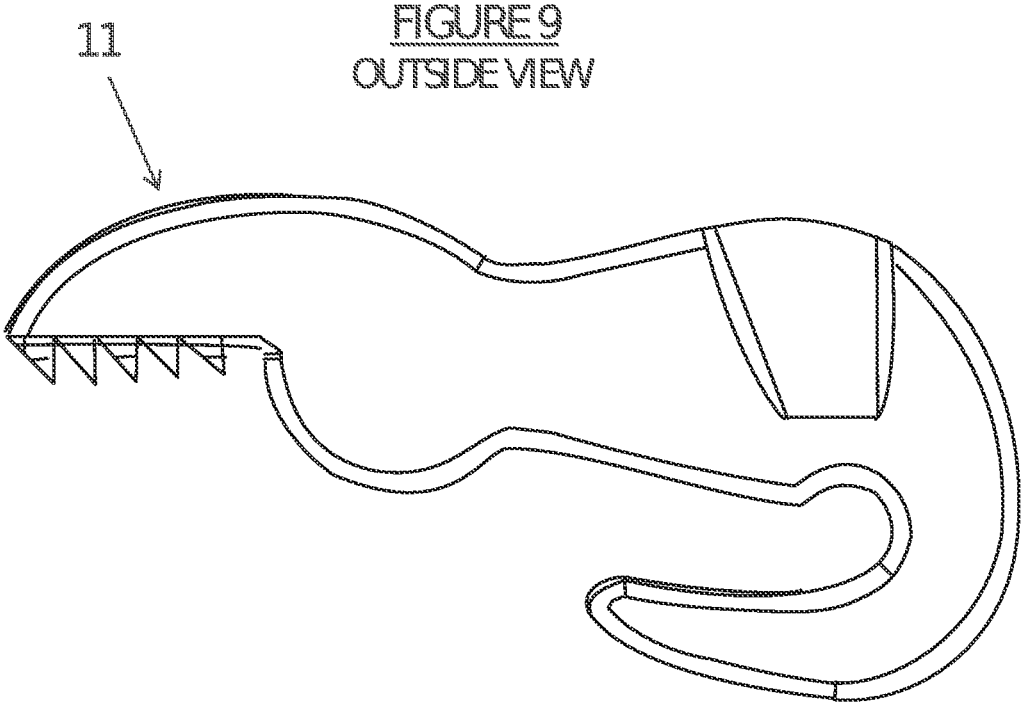
FIG. 9 is an outside view of the other side of a first embodiment of the clamp.
Figure 10:
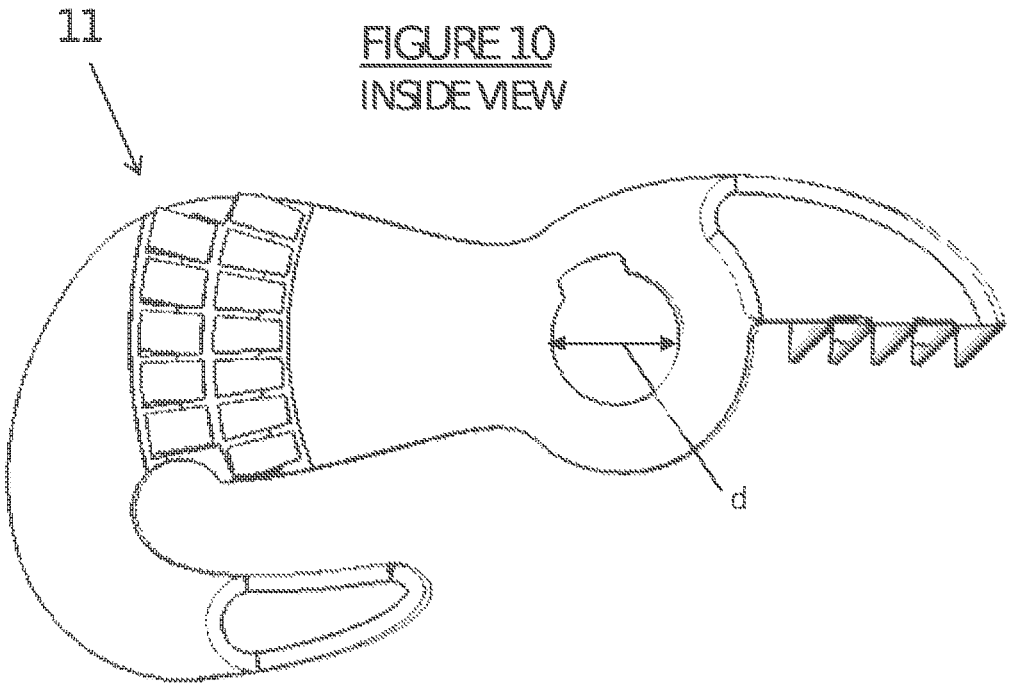
FIG. 10 is an inside view of the other side of a first embodiment of the clamp.
Figure 11:
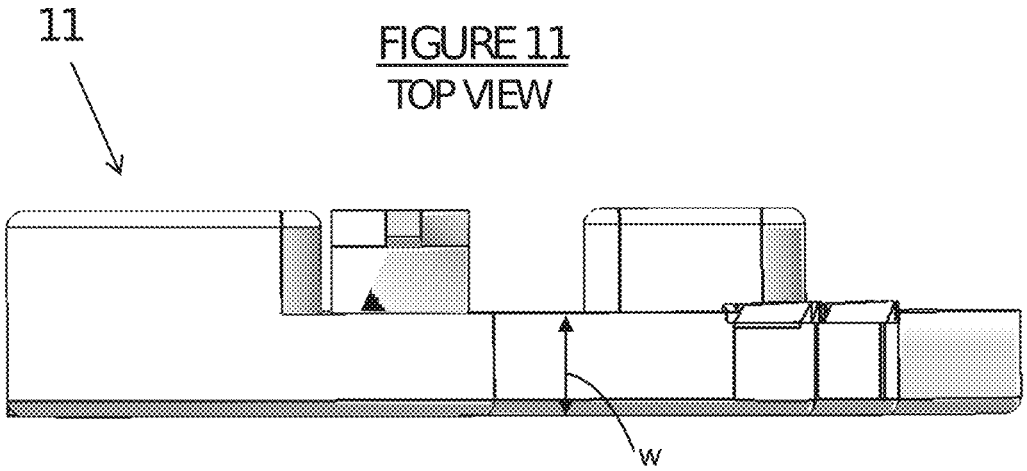
FIG. 11 is a top view of the other side of a first embodiment of the clamp.
Figure 12:
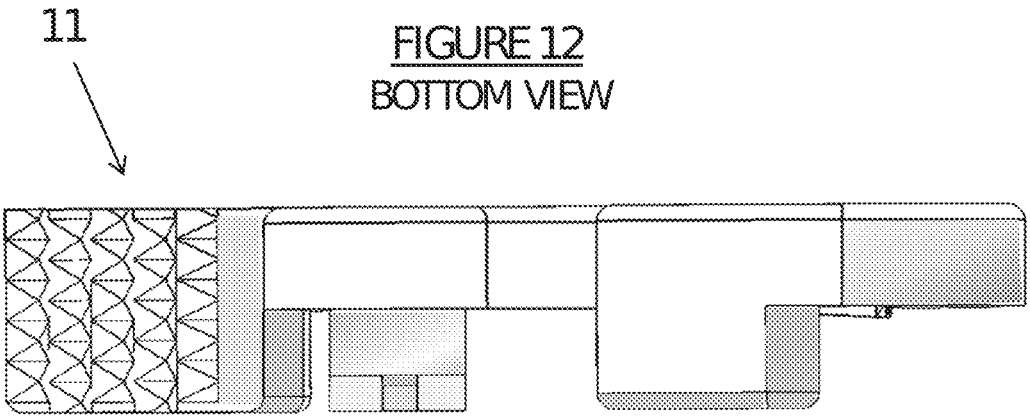
FIG. 12 is a bottom view of the other side of a first embodiment of the clamp.
Figure 13:
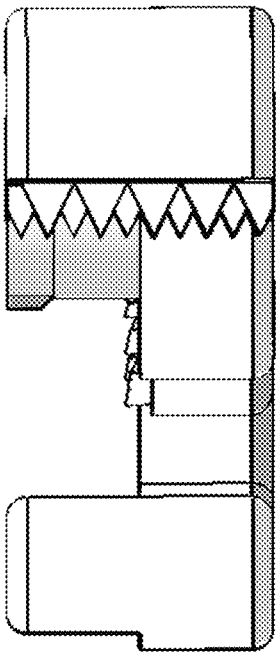
FIG. 13 is a front view of the other side of a first embodiment of the clamp.
Figure 14:
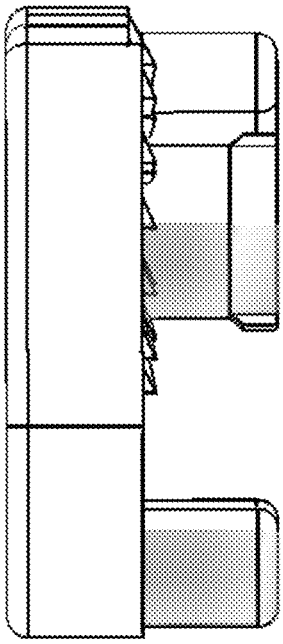
FIG. 14 is a rear view of the other side of a first embodiment of the clamp.

FIG. 2, is an exploded view of a first embodiment of the clamp, in which the axle 40 on clamp body 11 passes through the hole 41 on the opposing clamp body 10 with a hole. The axle tab 42 travels through the hole channel 44 until it reaches the depth of the tab retaining ledge 43, upon which the clamp bodies are twisted sideways such that the tab 42 rests upon the retaining ledge 43, thereby securing and retaining the clamp bodies together while actuating a "scissoring" clamp action.

FIGS. 3, 4, 5, 6, 7, and 8 show outside view, inside view, top view, bottom view, front view, and rear view of the clamp body 10, respectively.

FIGS. 9, 10, 11, 12, 13, and 14 show an outside view, inside view, top view, bottom view, front view, and rear view of the clamp body 11, respectively.

Figures 20, 21:
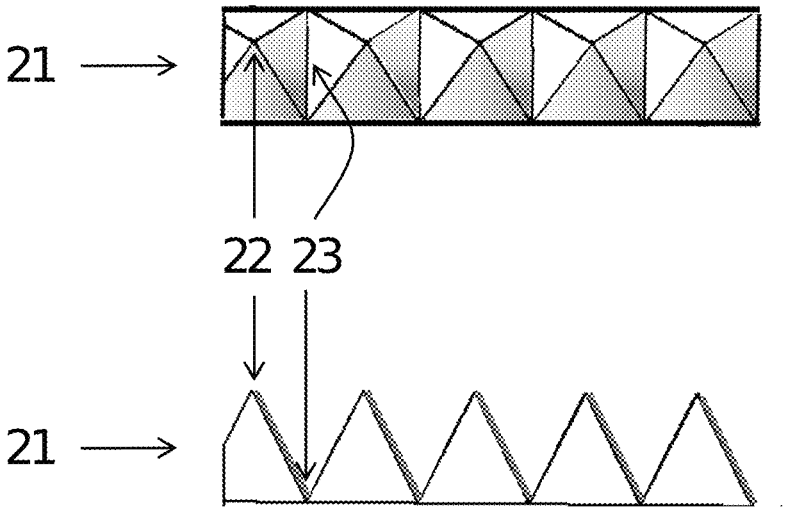
FIG. 20 is a top view of a single row of the teeth shown in FIG. 15.
FIG. 21 is a front view of a single row of the teeth shown in FIG. 15.

FIG. 15 shows a top view of a pattern of teeth 20 from within the mouth of the jaw 30 (see, FIG. 1). FIG. 16 shows a front view of the teeth 20. FIG. 17 shows the back view of the teeth 20. FIG. 18 shows the left view of the teeth 20 and FIG. 19 shows the right view of the teeth 20. FIG. 20 shows a top view of a row of teeth 21, the teeth are symmetrically aligned side by side, where a tooth 22 is correspondingly next to a tooth cavity 23, and where the tooth cavity dimensions are the same dimensions as the tooth. FIG. 21 shows the front view of the same row of teeth.

Figure 22:
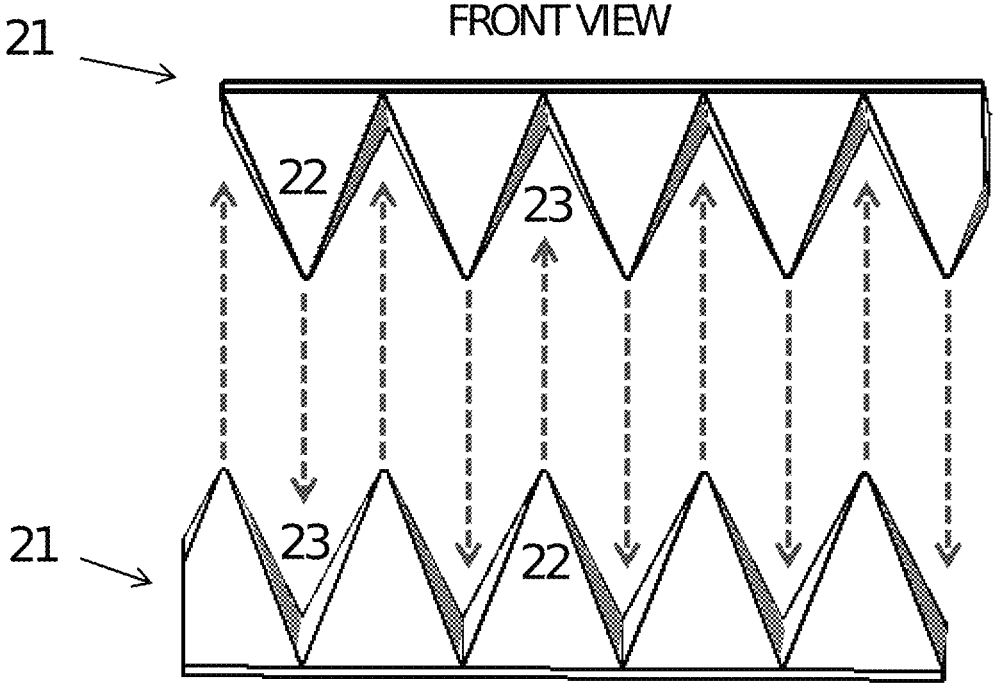
FIG. 22 is a front view of a s the teeth shown on the clamp showing their alignment.
Figure 23:
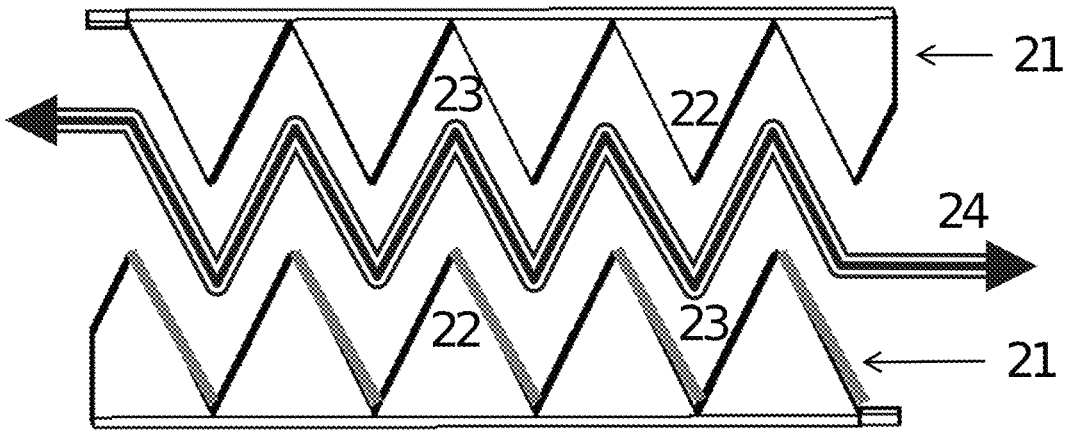
FIG. 23 is a front view of the teeth shown on the clamp showing how the alignment affects a piece placed in the clamp.

FIG. 22 shows two front rows of teeth 21, the rows symmetrically opposed and staggered to each other, where the teeth 22 of one row of teeth fit exactly into the corresponding tooth cavities 23 of the opposing row of teeth. FIG. 23 shows two front rows of teeth 21, the rows symmetrically opposed and staggered to each other, where the teeth 22 of one row of teeth fit into the corresponding tooth cavities 23 of the opposing row of teeth, and distort a material 24 placed between them. This kind of up and down tooth pattern arrests the lateral (side to side) movement of the material 24.

Figure 24:
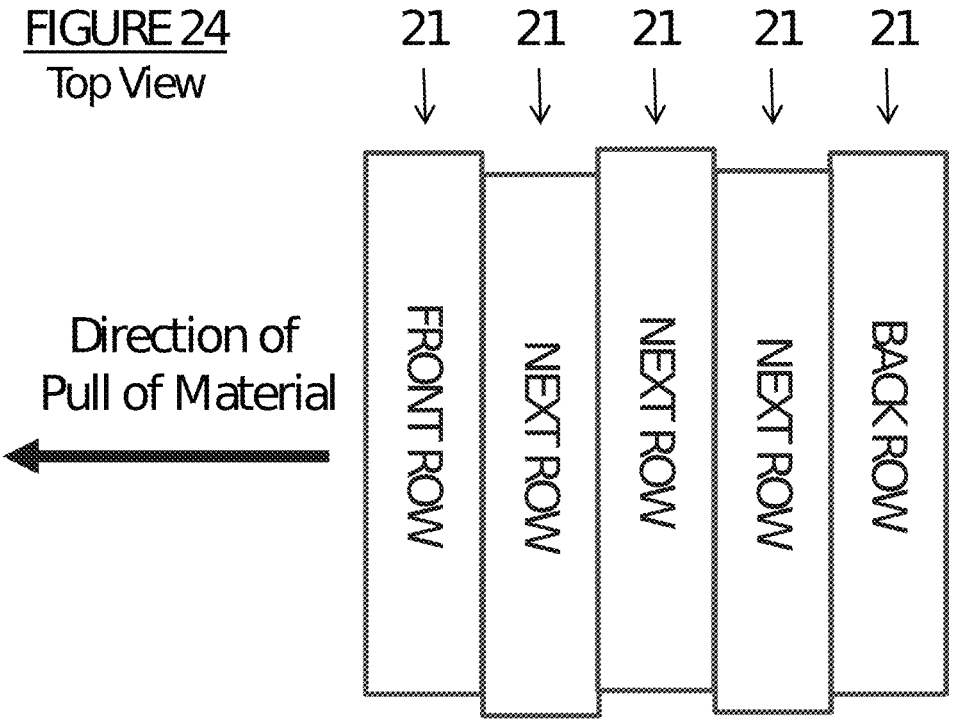
FIG. 24 is a diagrammatic view of a top view of the teeth showing the alignment and the direction of material pull.

FIG. 24 shows the top view of a layout format of multiple rows of teeth 21, from the front row to the back row, where an arrow shows the direction of pull of any material, or such, arrested by the rows of teeth.

Figure 25:
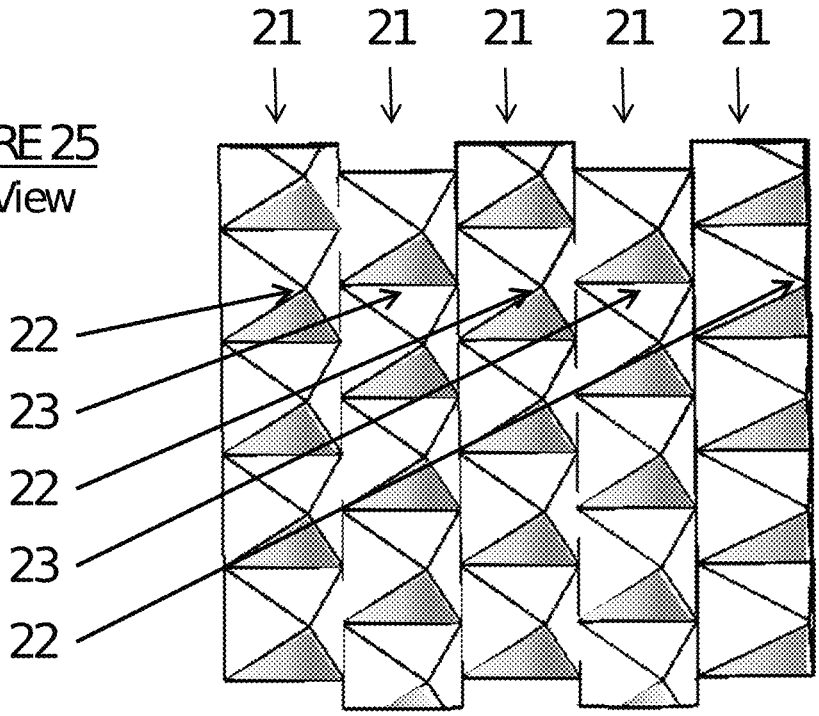
FIG. 25 is a diagrammatic view of the teeth on one part of the clamp, showing the staggered arrangement of the teeth.

FIG. 25 shows a top view of multiple rows of teeth 21, the rows are symmetrically staggered to each other such that a tooth 22 from the first row of teeth is directly in front of a tooth cavity 23 of the next row of teeth, and that tooth cavity is directly in front of the next tooth 22 of the next row of teeth, etc.

Figure 26:
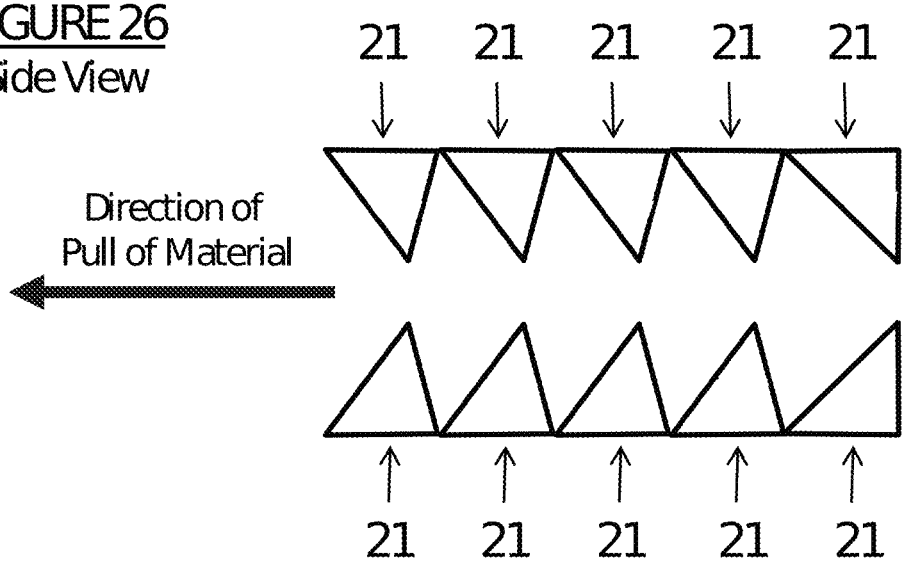
FIG. 26 is a diagrammatic view of a side view of the teeth showing the alignment and the direction of material pull.

FIG. 26 shows the side view of two sets of multiple rows of teeth 21, each set facing each other and in an open position. This illustration shows an arrow of the direction of the pull of material or such.

Figure 27:
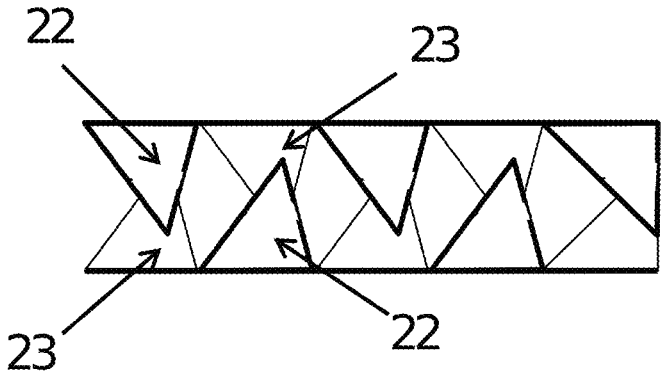
FIG. 27 is a side view of the closed teeth.

FIG. 27 shows the side view of two sets of multiple rows of teeth 21, each set facing each other and in a closed position. A tooth 22 from one set of teeth is filling the tooth cavity 23 from an opposing set of teeth.

Figure 28:
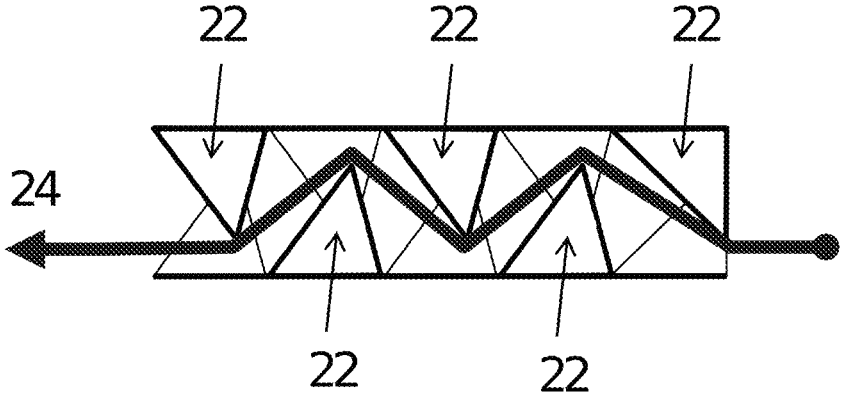
FIG. 28 is a side view of the closed teeth showing an object held therein.

FIG. 28 shows the side view of two sets of multiple rows of teeth in a closed position on a material 24 or such, where the material is distorted by the offset of the opposing teeth 22 in an up and down grip, from row of teeth to row of teeth.

This kind of up and down, back to front tooth pattern arrests the pulling movement of the material 24.

Figure 29:
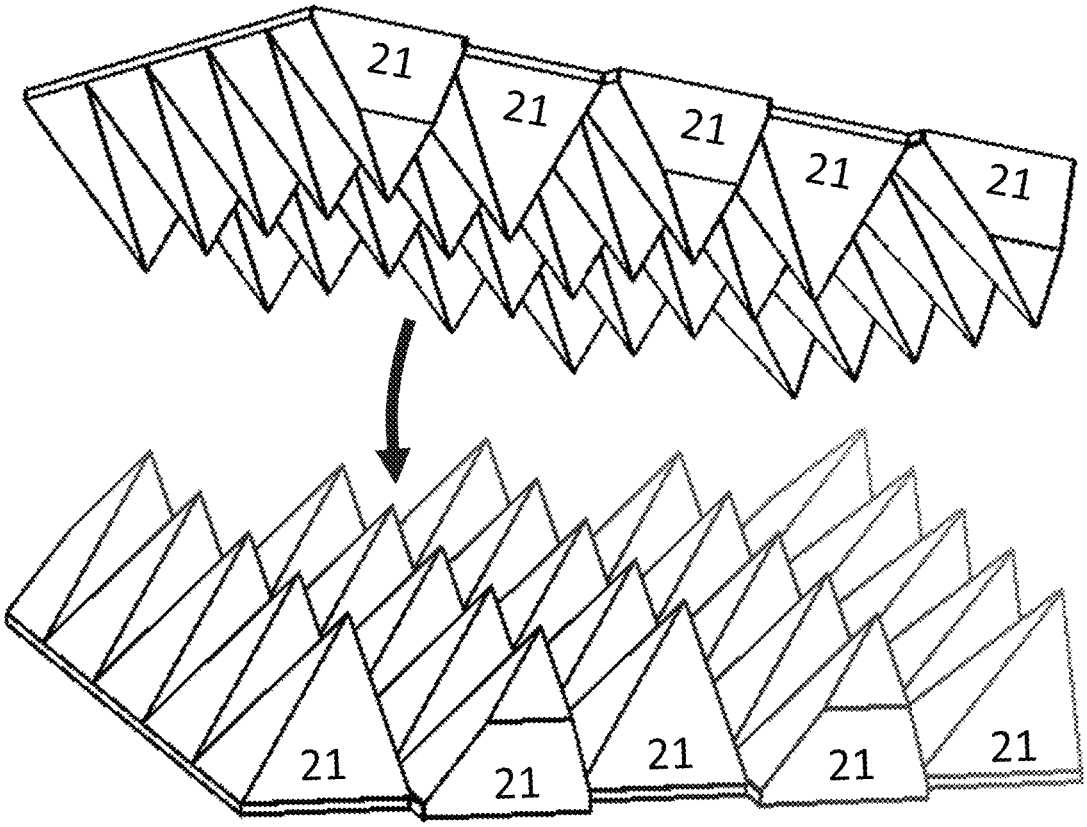
FIG. 29 is a perspective view of the teeth of the clamp shown open.

FIG. 29 shows the perspective view of five rows of teeth 21 in an open position above five rows of teeth 21, and the two sets of teeth are beginning to close together.

Figure 30:
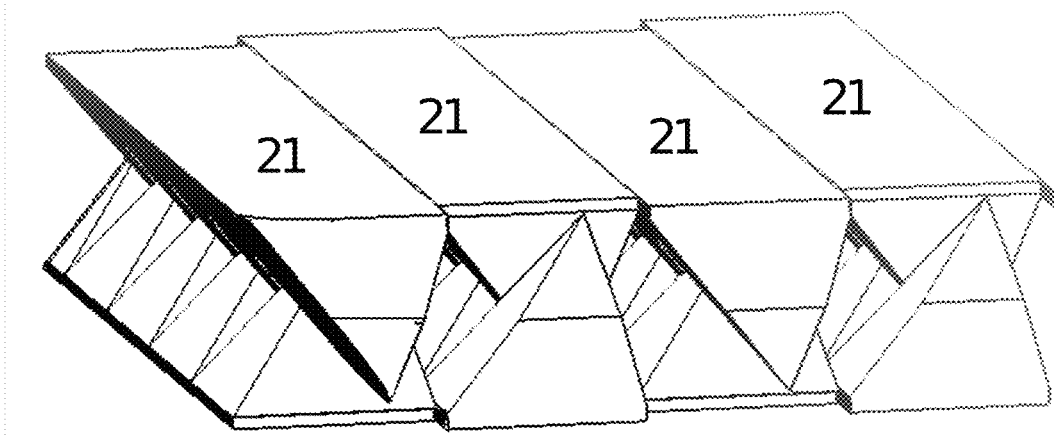
FIG. 30 is a perspective view of the teeth of the clamp shown closed.

FIG. 30 shows the perspective view of four rows of teeth 21 in a closed position with an opposing four rows of teeth.

FIGS. 31, 32, 33, and 34 show a perspective view of different profiles of teeth, where a row of teeth may have a leaning bias in their tooth profile that gives the force of the material pulling against them an easier relief, a harder relief, or a combination of both. FIG. 31 would have the easiest relief, and FIG. 34 would have the hardest relief.

Figure 35:
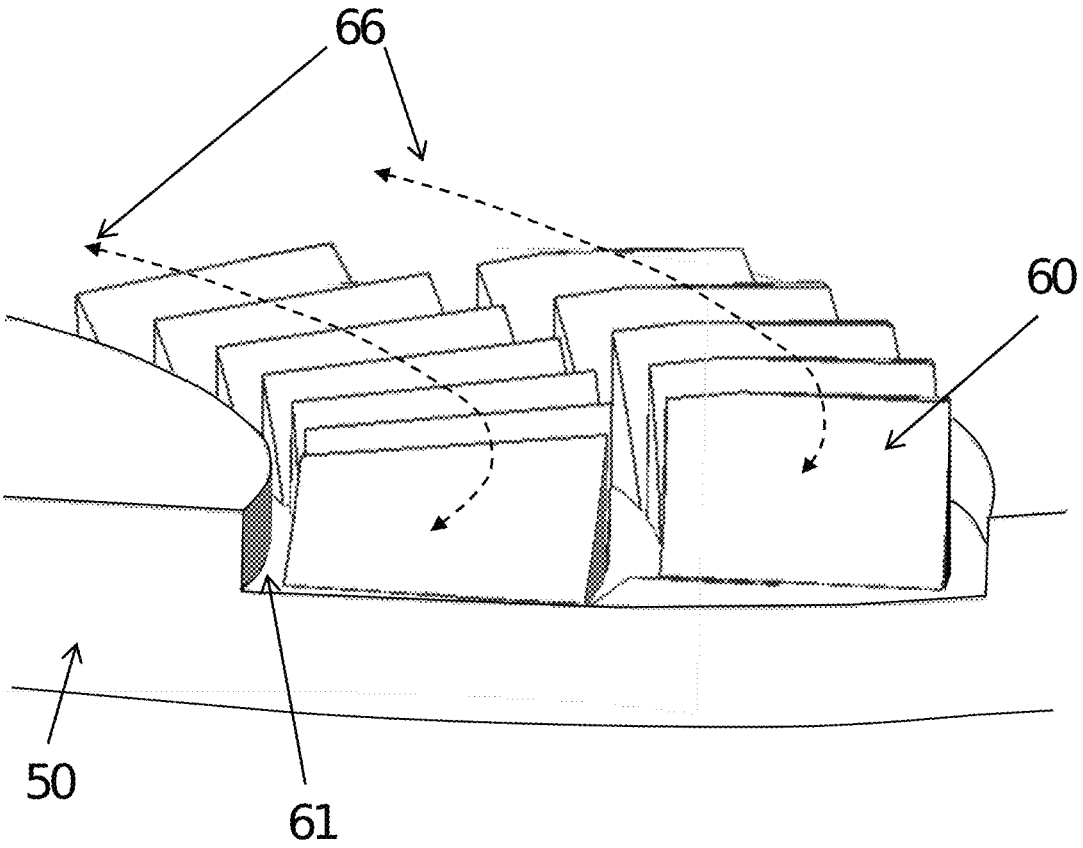
FIG. 35 is a perspective view of one side of the locking portion of the clamp.

FIG. 35 shows a perspective view of a multi-radius latching system on the inside body of a handle 50. In this embodiment, latches 60 are located on the inside of a handle 50, where they are recessed into a channel 61 in the handle, and where they are positioned in multiple rows, each row aligned on a different radius curve 66 that is determined by the center of the axle 65, said axle shown in FIG. 42.

Figure 36:
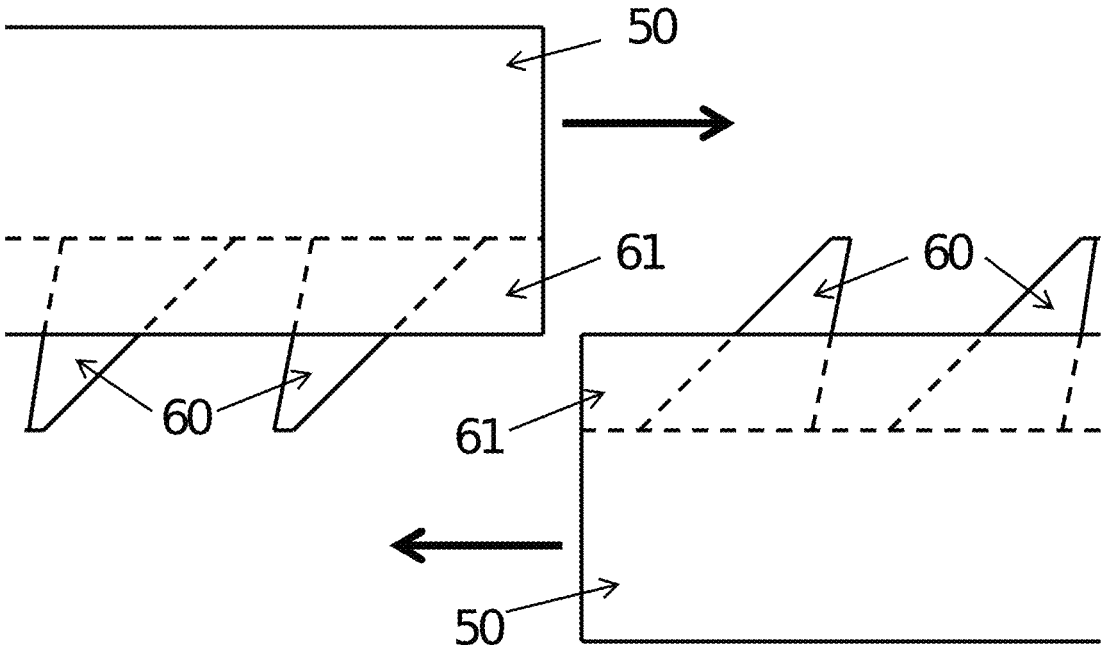
FIG. 36 is a rear diagrammatic view of the two parts of the locking portion of the clamp coming together.

FIG. 36 shows a rear view of two opposing single rows of latches 60, mounted inside their respective channels 61, on the inside of two opposing handles 50, and they are approaching each other for engagement as represented by the black arrows.

Figure 37:
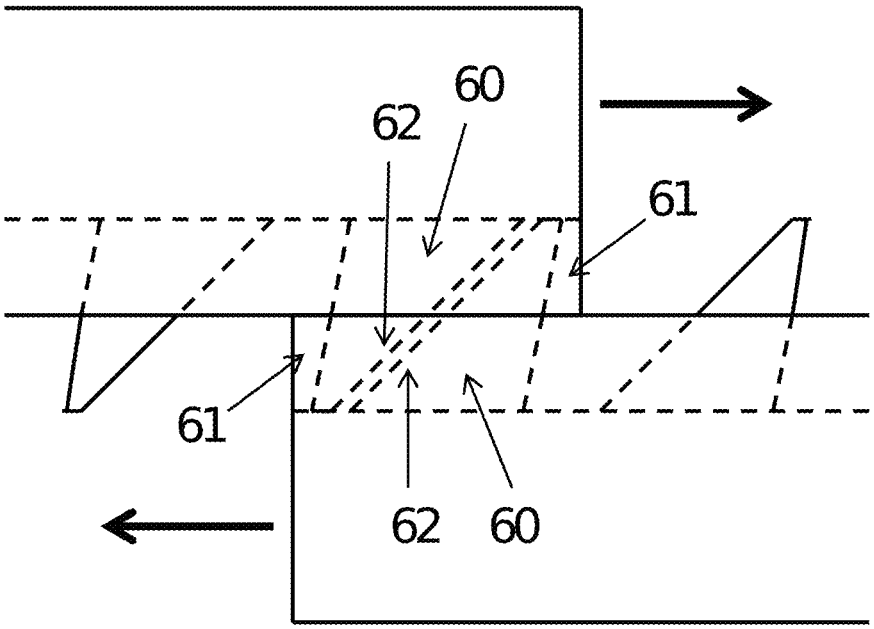
FIG. 37 is a rear diagrammatic view of the two parts of the locking portion of the clamp having made initial contact.

FIG. 37 shows a rear view of the latches 60, having approached each other for engagement as represented by the black arrows, whereon they have entered their respective opposing recessed channels 61, and the latch faces 62 are almost touching each other.

Figure 38:
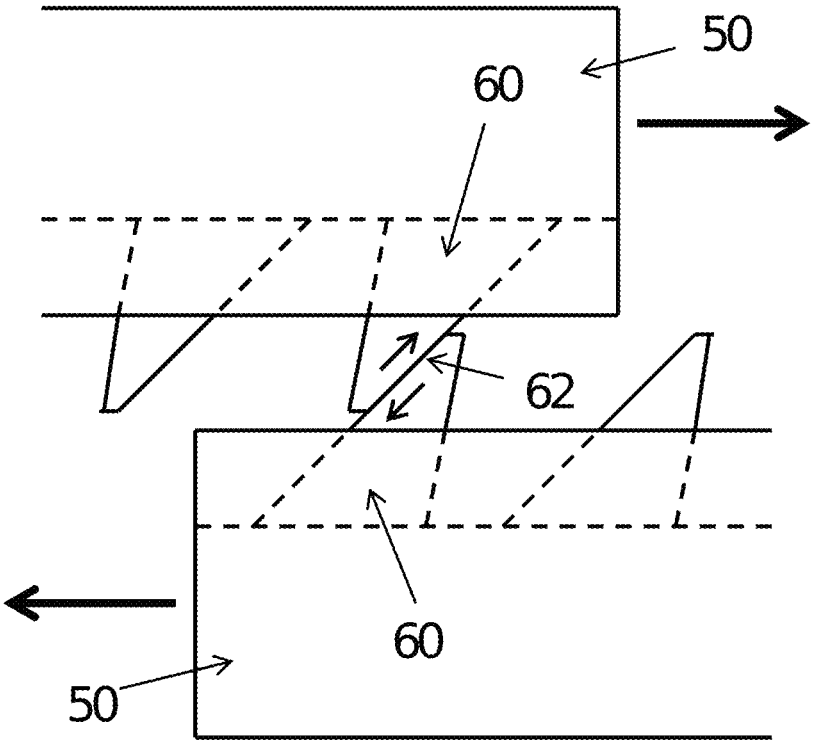
FIG. 38 is a rear diagrammatic view of the two parts of the locking portion of the clamp showing the teeth of the locking portion sliding over each other as the lock is engaging.

FIG. 38 shows a rear view of the latch faces 62 of the two opposing latches 60 on the inside of each handle 50, whereon they are sliding over each other, and outwardly from each other, seeking the path of least resistance, as represented by the black arrows.

Figure 39:
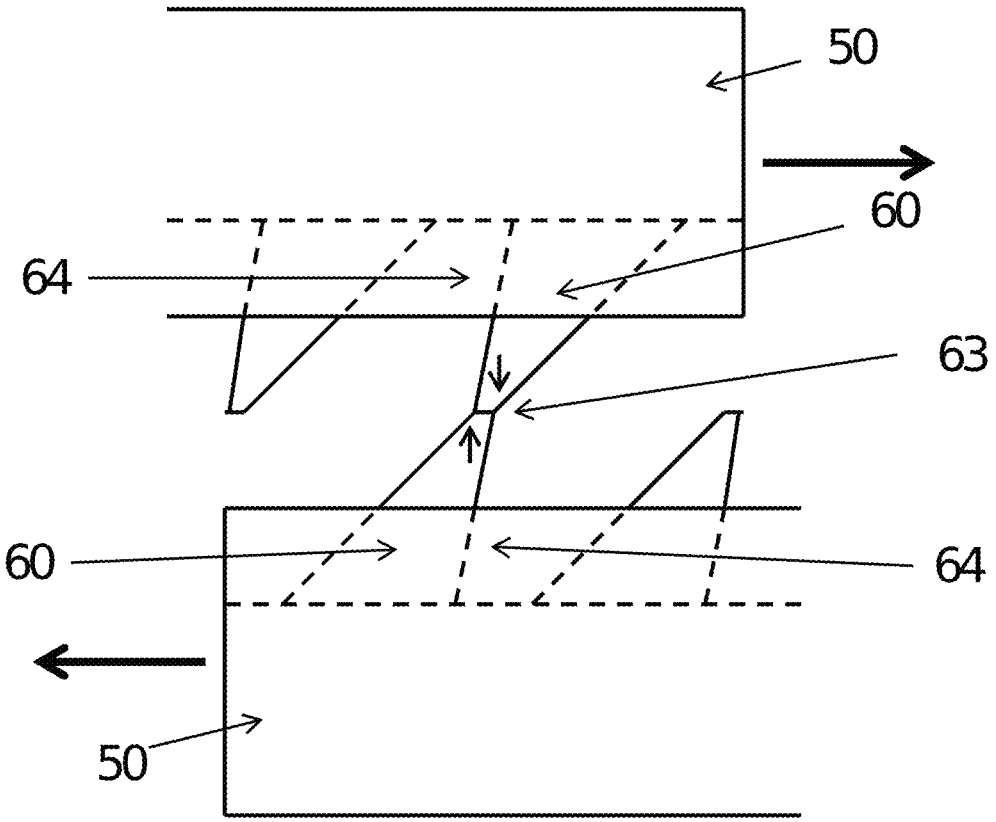
FIG. 39 is a rear diagrammatic view of the two parts of the locking portion of the clamp showing the teeth of the locking portion sliding over each other as the lock is engaging.

FIG. 39 shows a rear view of the latch edges 63 of the two opposing latches 60 on the inside of each handle 50, whereas they are momentarily resting on each other before the latches travel into their opposing latch receptacles 64, seeking the path of least resistance as represented by the black arrows, in order to become fully engaged with each other.

Figure 40:
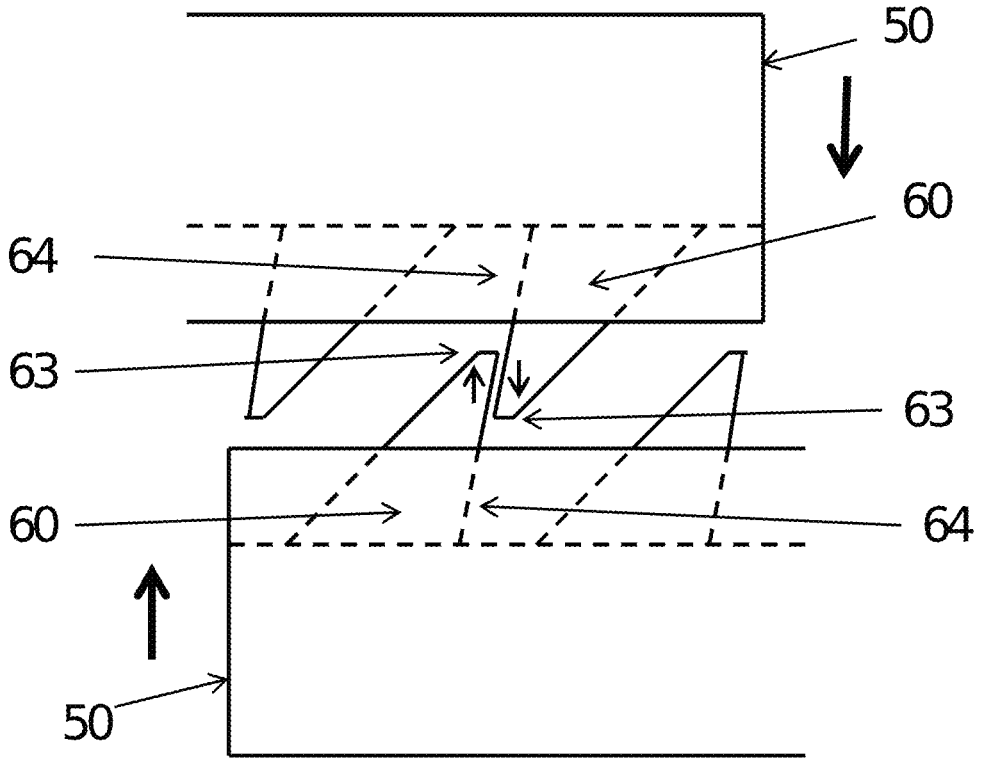
FIG. 40 is a rear diagrammatic view of the two parts of the locking portion of the clamp showing the teeth of the locking portion sliding over each other as the lock is engaging.

FIG. 40 shows a rear view of the latch edges 63 of the two opposing latches 60 on the inside of each handle 50, whereas they have begun to lead each latch into their opposing latch receptacle 64, seeking the path of least resistance as represented by the black arrows, in order to become fully engaged with each other.

Figure 41:
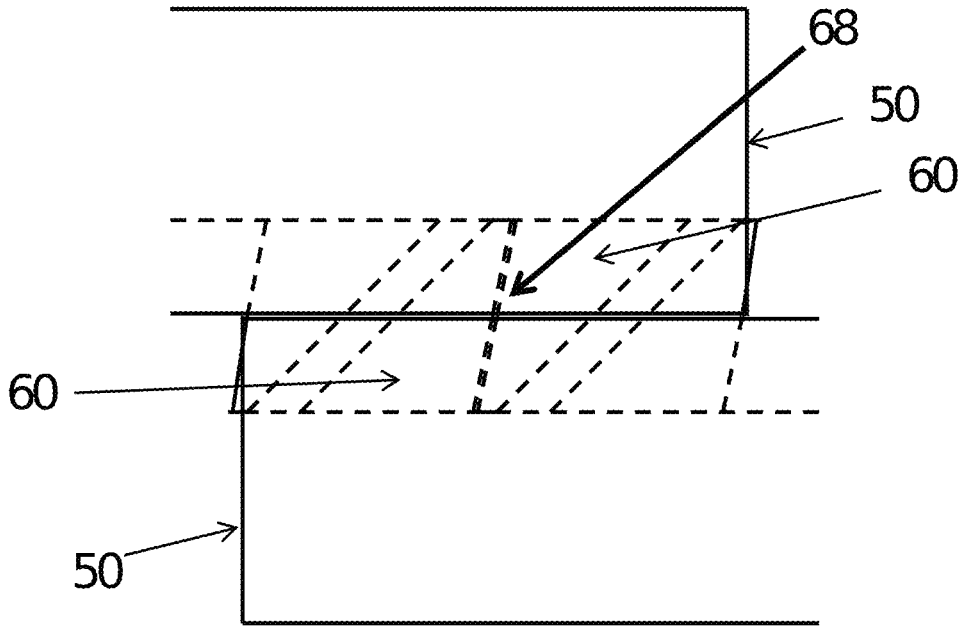
FIG. 41 is a rear diagrammatic view of the two parts of the locking portion of the clamp showing the teeth of the locking portion sliding over each other as the lock is fully engaged.

FIG. 41 shows a rear view of the two opposing latches 60 on the inside of each handle 50, whereas both latches have become fully engaged with each other 68.

Figure 42:
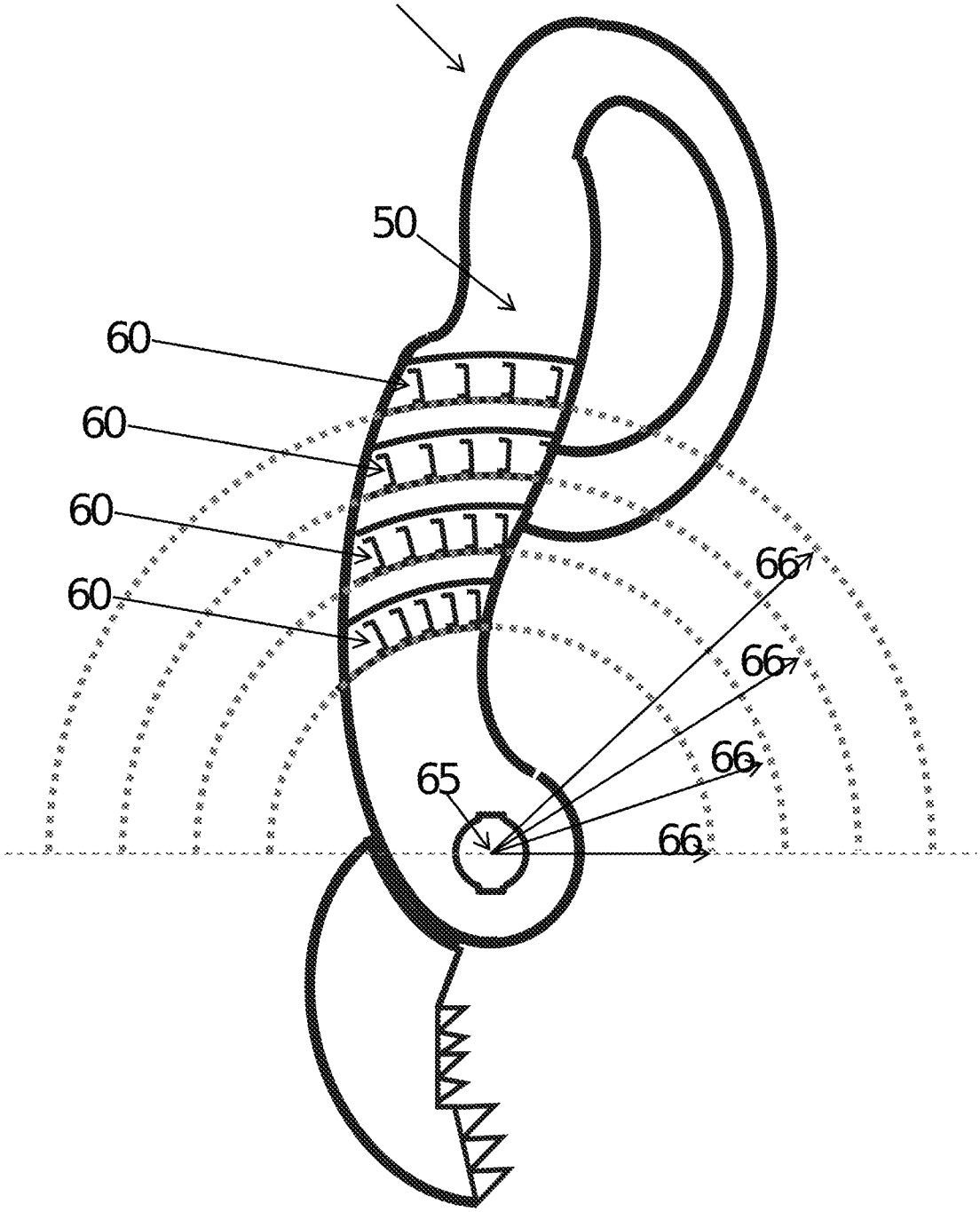
FIG. 42 shows the placement of the locking notches on a handle of a second embodiment of clamp.

FIG. 42 shows an Inside view of a clamp body 11, whereon rows of latches 60 are located on the inside of a handle 50, and positioned in multiple rows, the rows being separated and defined by different latch-positioning radius lines 66 from the axle center 65. More than one latch may be positioned on the same radius.

Figure 43:
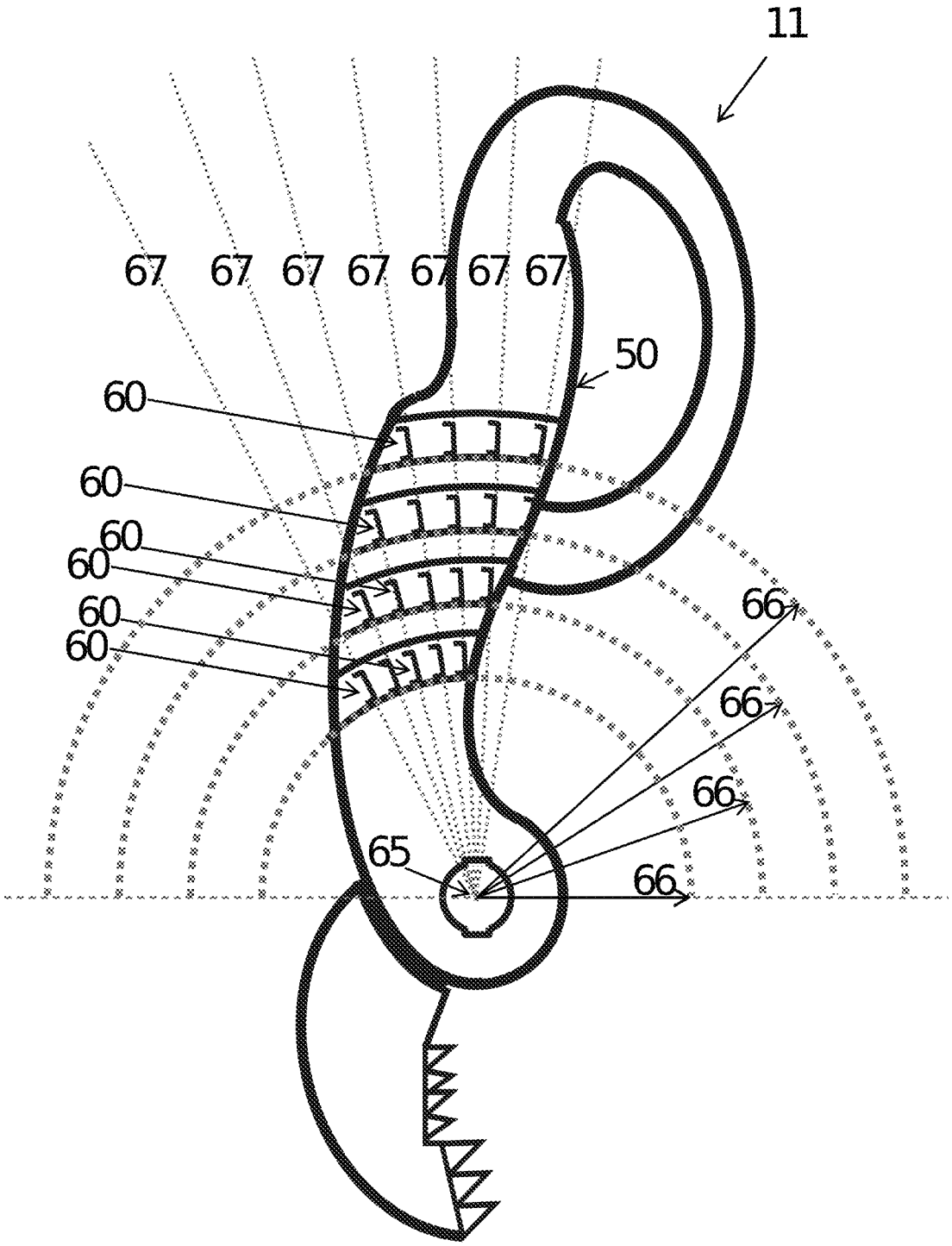
FIG. 43 shows the angles related to the placement of the locking notches on a handle of a second embodiment of clamp.

FIG. 43 shows an inside view of a clamp body 11. The latch-positioning radius lines 66 intersect with latch-positioning degree lines 67, originating from the axle center 65, whereas the degree lines are of equal degrees of separation from each other, as shown. On the inside of the handle 50, at the intersection of a radius line and a degree line, a latch 60 is positioned. More than One latch may be on a degree line.

Figure 44:
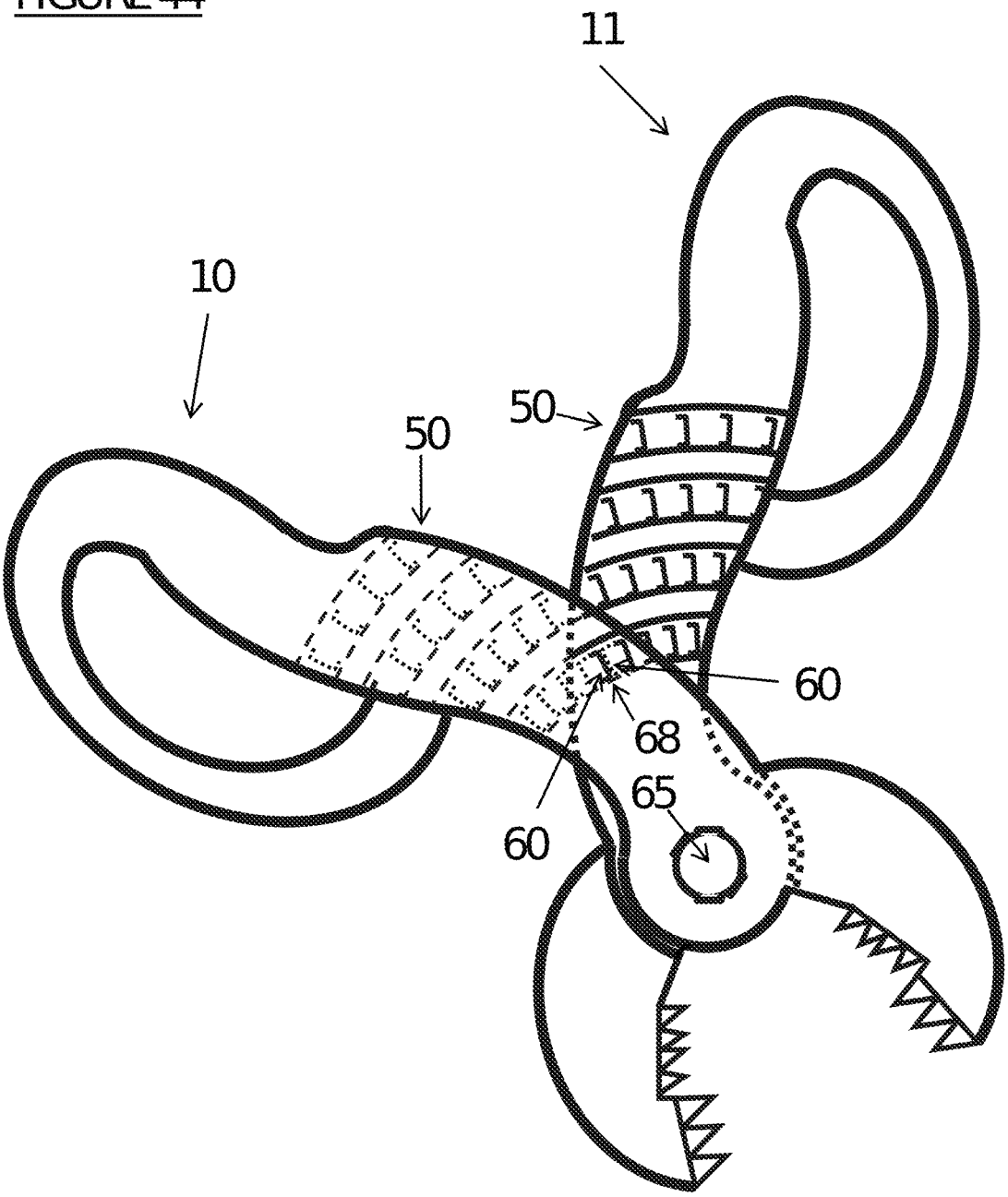
FIG. 44 is a diagrammatic view of the second embodiment of the clamp showing the alignment of the locking latches with the clamp open.

FIG. 44 shows an inside view of a clamp body 11 and an outside view of a clamp body 10 in an assembled and open position. The two clamp bodies are attached at the axle 65, where the first-to-touch opposing latches 60 from each handle 50 are fully engaging 68.

Figure 45:
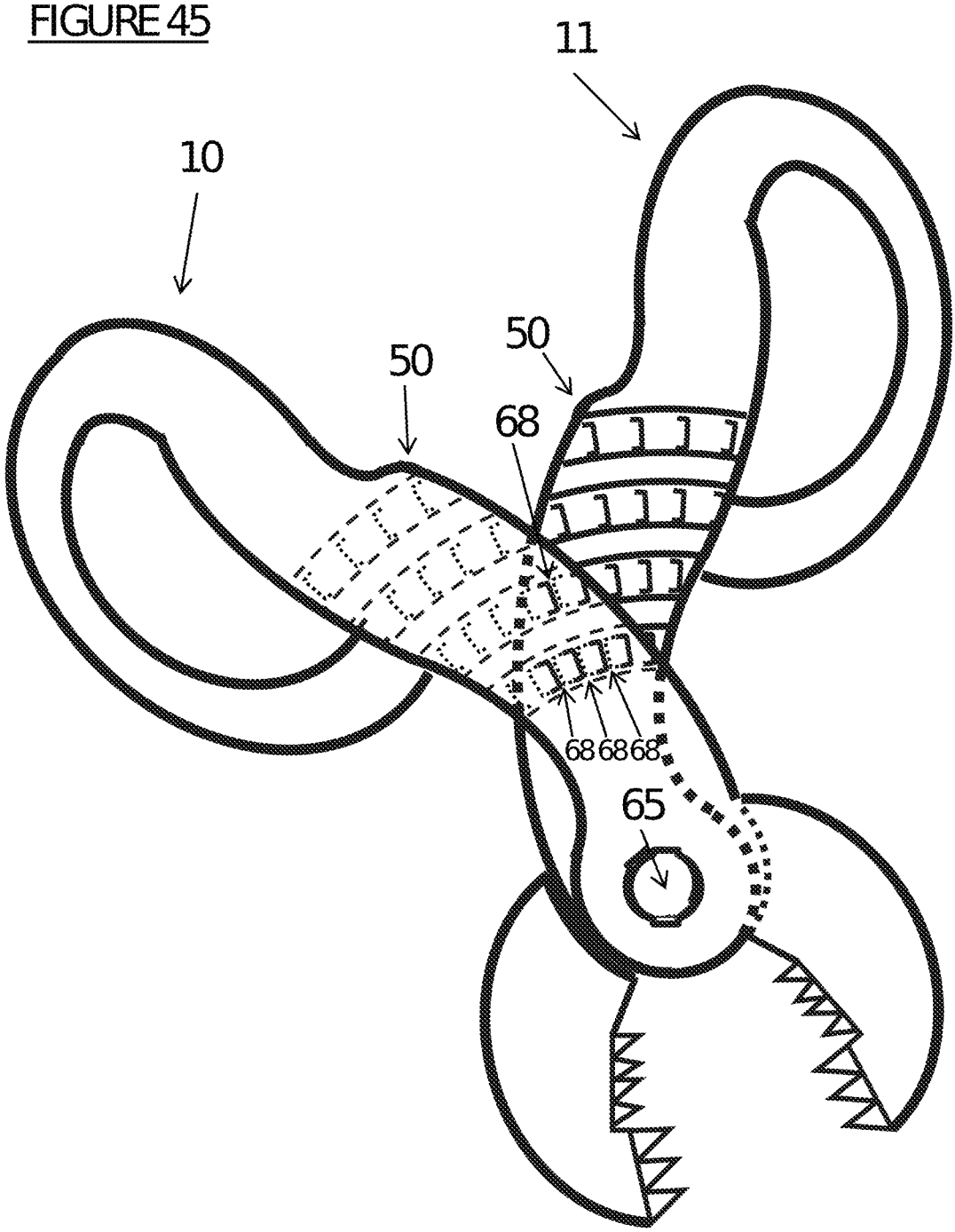
FIG. 45 is a diagrammatic view of the second embodiment of the clamp showing the alignment of the locking latches with the clamp being closed.

FIG. 45 shows an inside view of a clamp body 11 and an outside view of a clamp body 10 in an assembled position and beginning-to-close position. The two clamp bodies are attached on an axle 65 and are closing together, whereas multiple opposing latches 60 are catching and engaging 68, at the intersection of the degrees lines 67 (in FIG. 43) and the radius lines 66 (in FIG. 43) of each handle 50.

Figure 46:
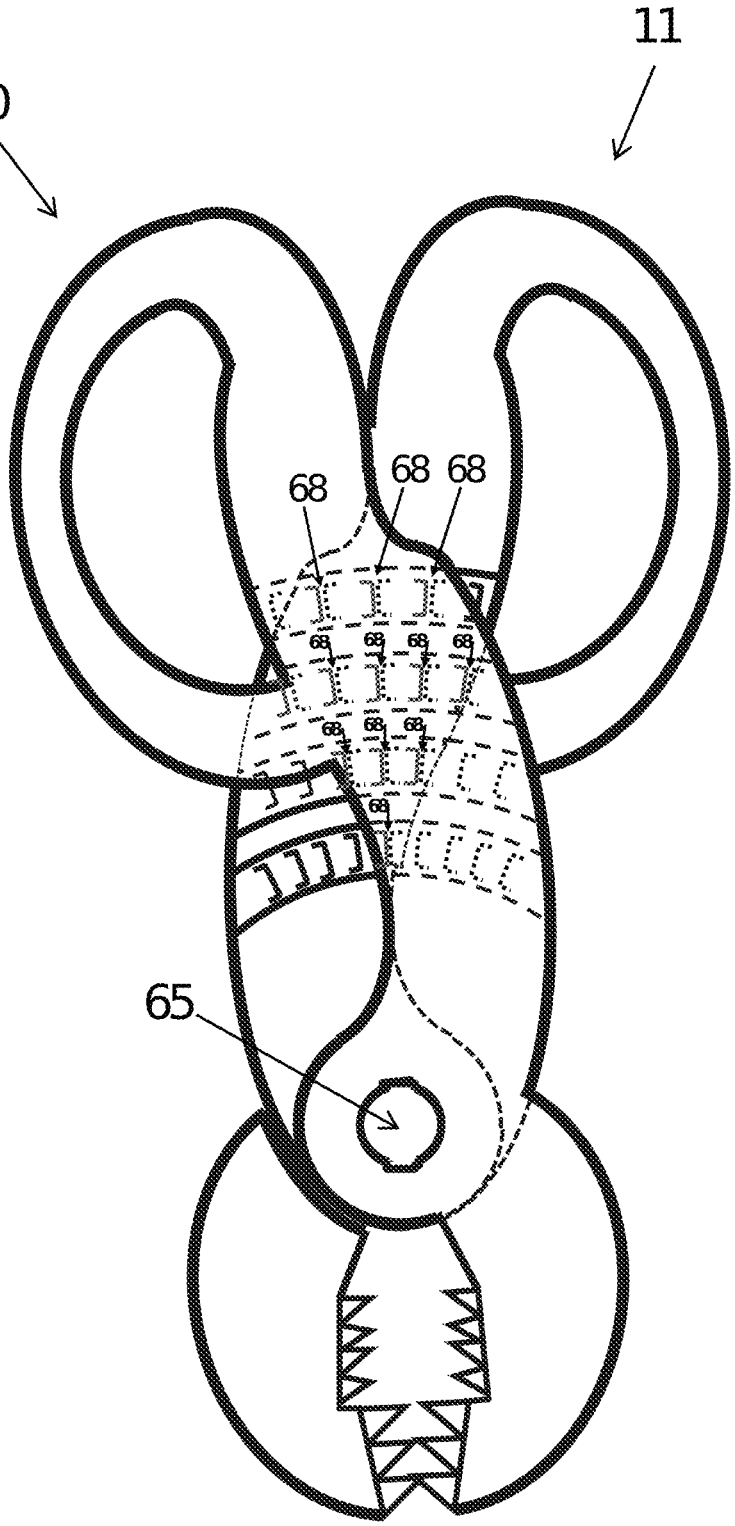
FIG. 46 is a diagrammatic view of the second embodiment of the clamp showing the alignment of the locking latches with the clamp closed.

FIG. 46 shows an inside view of a clamp body 11 and an outside view of a clamp body 10, attached together by an axle 65, in a fully closed position, where a multiple of opposing latches 60 are catching and engaging 68.

Figure 47:
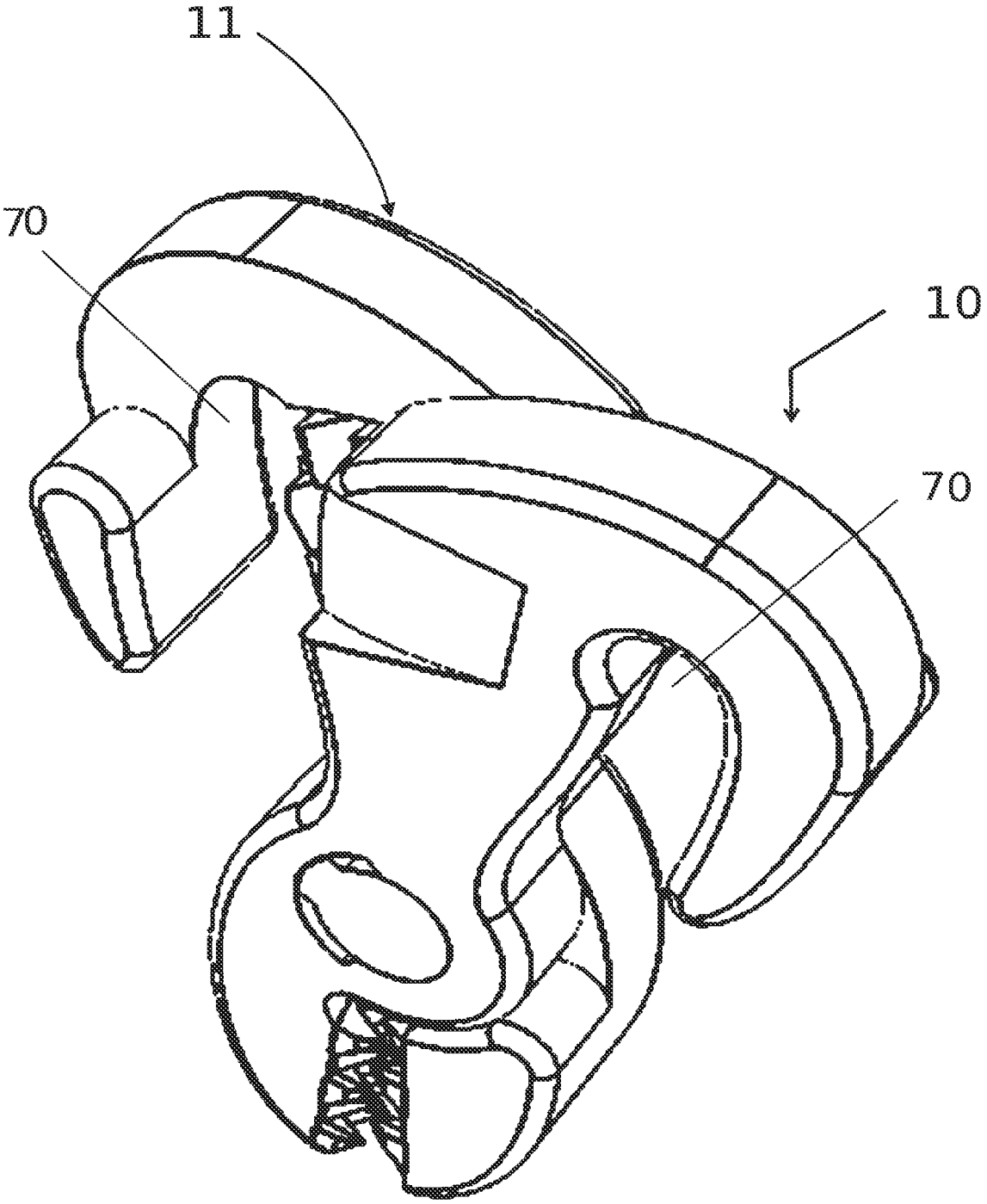
FIG. 47 shows a perspective view of clamp body assembled and fully closed position, showing a hook area on both clamp body parts.

FIG. 47 shows a perspective view of clamp body with hole 10 and clamp body with axle 11 in an assembled and fully closed position. The hook area 70 is shown for each clamp body.

Figure 48:
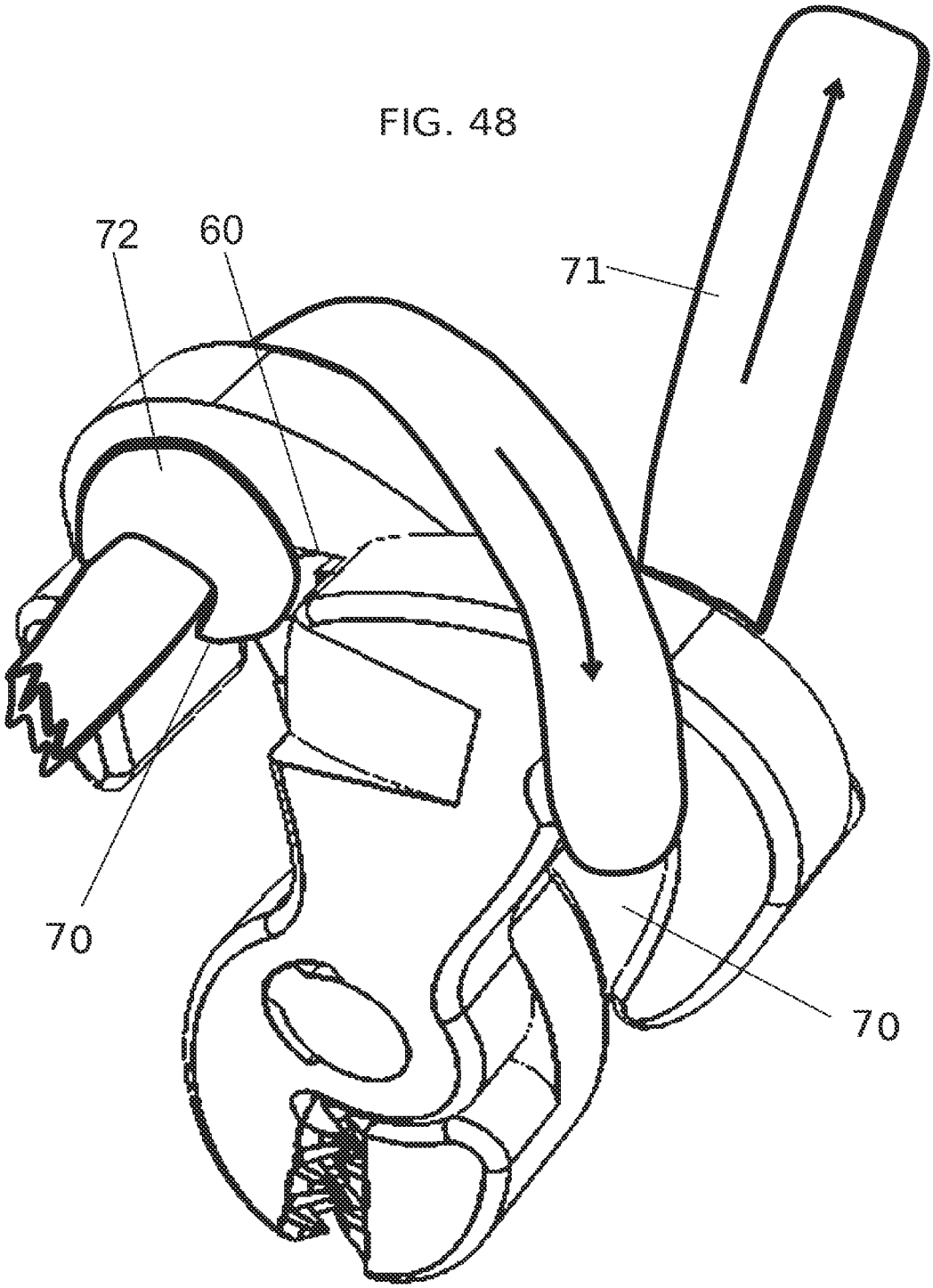
FIG. 48 shows a perspective view of clamp body assembled and fully closed position, and a line engaged with the hooks of both clamp bodies in a figure eight engagement, with one end of the line captured in one of the hooks by a knot.

FIG. 48 shows a perspective view of clamp body with hole 10 and clamp body with axle 11 in an assembled and fully closed position, and a line 71 engaged with the hooks 70 of both clamp bodies in a figure eight engagement, with one end of the line captured in one of the hooks by a knot 72. The line shows a pulling force (arrows) that both pulls the clamp tighter on its axle 40 as well as pull the latch system 60 more firmly onto each other.

Figure 49:
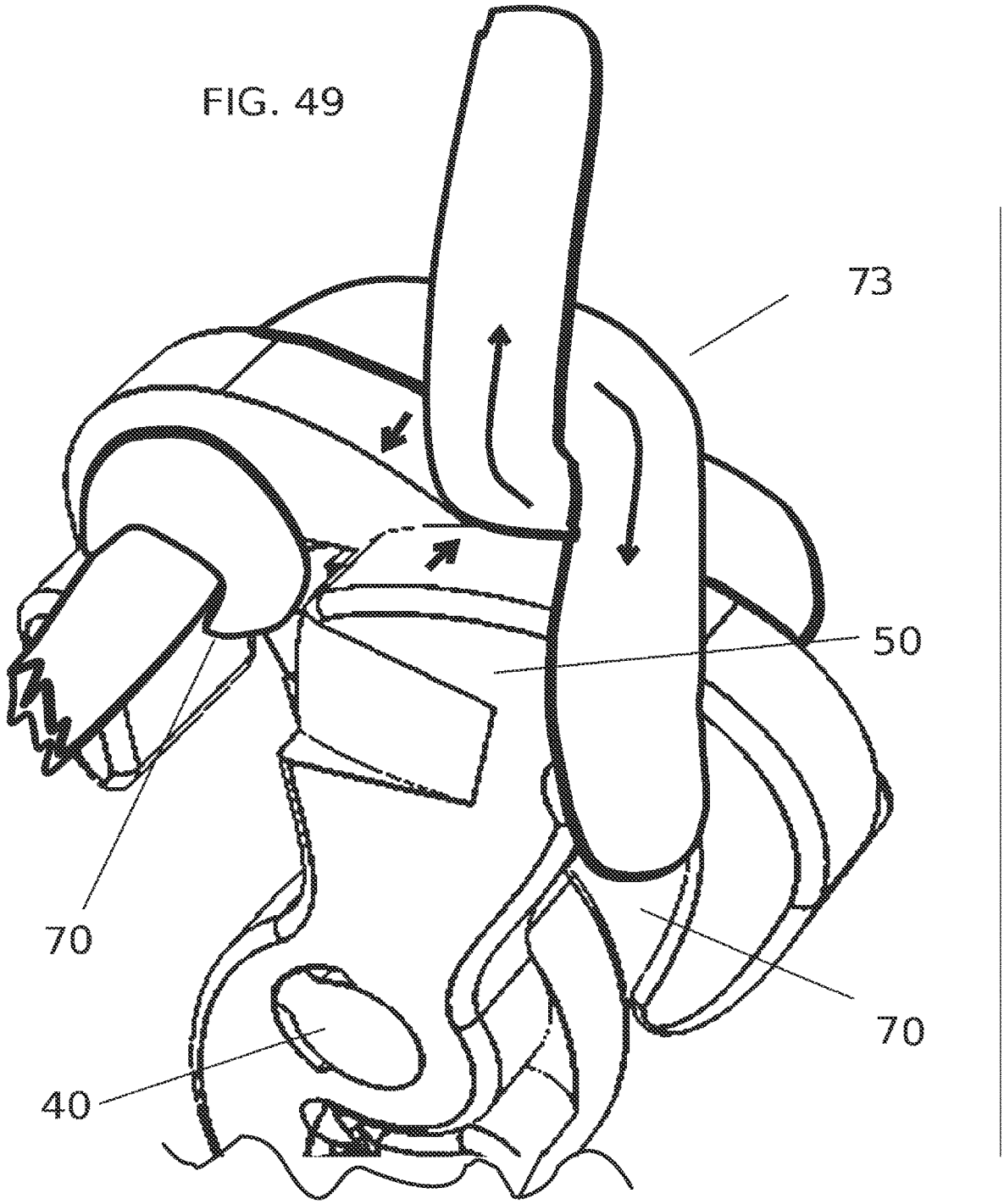
FIG. 49 shows a perspective view of clamp body assembled and fully closed position, as shown in FIG. 48, with one end of the line captured in one of the hooks by a knot.

FIG. 49 shows a perspective view of clamp body with hole 10 and clamp body with axle 11 in an assembled and fully closed position, and a line 71 engaged with the hooks 70 of both clamp bodies in a figure eight and half hitch 73 engagement, with one end of the line captured in one of the hooks by a knot 72. The line shows a pulling force (long arrows) that pulls the clamp arms 50 tighter together on the axle 40, as well as pull the latch system 60 more firmly onto each other (small arrows). The use of the knot and half-hitch method pulls the clamp tighter together the more a pulling force is applied. The half-hitch makes the simple knot more difficult to come off of the hook, the half-hitch also centers the pulling force over the middle of the two hooks. It is simple to undo the half-hitch and knot, compared to undoing a complex knot.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A locking clamp comprising:

a) a first arm, having a handle end having an inner wall surface, a mouth end, a width, and a hole formed therebetween;

b) a second arm, having a handle end having an inner wall surface, a mouth end and an axle formed therebetween, said second arm being joined to said first arm such that said first arm and said second arm are pivotably connected about said axle;

c) an array of teeth formed on the mouth end of said first arm, said array of teeth of said first arm having at least three rows, each of said at least three rows being spaced apart to form cavities between said at least three rows of teeth of said first arm;

d) an array of teeth formed on the mouth end of said second arm, said array of teeth of said second arm having at least three rows, each of said at least three rows being spaced apart to form cavities between said at least three rows of teeth of said second arm;

e) at least one latch protruding from the inner wall surface of said handle end of said first arm;

f) at least one recess formed on the inner wall surface of said handle end of said second arm;

g) whereby said locking clamp has an open position and a closed position;

h) whereby when said locking clamp is in said closed position, said array of teeth on said second arm being offset from said array of teeth on said first arm such that said array of teeth on said first arm mesh with the array of teeth on said second arm; and i) when said locking clamp is in said closed position, said at least one latch in on the inner wall surface of said handle end of said first arm engages with said at least one recess on the inner wall surface of said handle end of said second arm to lock said locking clamp together.

2. The locking clamp of claim 1 whereby said first and second arms have a lateral stability.

3. The locking clamp of claim 1 wherein the arrays of teeth on said first and second arms restrain a material placed therebetween from both forward movement as well as lateral movement.

4. The locking clamp of claim 1 wherein said at least one latch on said first arm further comprises a plurality of multi-radius latches formed on the inner wall surface of said handle end of said first arm and said at least one recess on said second arm further comprises a plurality of multi-radius recess on the inner wall surface of said handle end of said second arm such that when said locking clamp is closed, said plurality of multi-radius latches and said plurality of multi-radius recesses interlock holding said locking clamp in the closed position.

5. The locking clamp of claim 4 wherein said plurality of multi-radius latches and said plurality of multi-radius recesses are set in a plurality of rows, each row having a different radius from the center of the axle.

6. The locking clamp of claim 1 further comprising:

a) a hook formed on said first arm; and b) a hook formed on said second arm.

7. The locking clamp of claim 6 further comprising a length of a rope [Fish] secured on said hooks.

8. The locking clamp of claim 7 wherein the length of said rope is secured by a knot.

9. The locking clamp of claim 8 wherein the knot is a half-hitch knot.

* * * * *